US012540786B2

(12) United States Patent
Lynch

(10) Patent No.: US 12,540,786 B2
(45) Date of Patent: Feb. 3, 2026

(54) MODULAR AR-TYPE SAFETY SELECTOR WITH LEVER MOUNTING PINS

(71) Applicant: MAGPUL INDUSTRIES CORP., Austin, TX (US)

(72) Inventor: Clinton Wade Lynch, Erie, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/719,788

(22) PCT Filed: Dec. 19, 2022

(86) PCT No.: PCT/US2022/053374

§ 371 (c)(1),
(2) Date: Jun. 13, 2024

(87) PCT Pub. No.: WO2023/122021

PCT Pub. Date: Jun. 29, 2023

(65) Prior Publication Data

US 2025/0052531 A1 Feb. 13, 2025

Related U.S. Application Data

(60) Provisional application No. 63/291,720, filed on Dec. 20, 2021.

(51) Int. Cl.

| | |
|---|---|
| ***F41A 17/74*** | (2006.01) |
| ***F41A 19/46*** | (2006.01) |
| ***F41A 35/06*** | (2006.01) |

(52) U.S. Cl.
CPC ..... *F41A 17/74* (2013.01); *F41A 19/46* (2013.01); *F41A 35/06* (2013.01)

(58) Field of Classification Search
CPC ..... F41A 17/46; F41A 35/06
See application file for complete search history.

(56) References Cited

U.S. PATENT DOCUMENTS 829,486 A * 8/1906 O'Meara ..... F16B 21/12 251/83
3,057,101 A 10/1962 Miller et al.
(Continued)

FOREIGN PATENT DOCUMENTS

WO 2023122021 A1 6/2023

OTHER PUBLICATIONS

European Patent Application No. 22912349.2, Extended European Search Report dated Nov. 4, 2024. 14 pages.
(Continued)

*Primary Examiner* — Gabriel J. Klein
(74) *Attorney, Agent, or Firm* — NOD Law PC

(57) ABSTRACT

A safety selector lever assembly may include a selector core comprising an elongated section having a curved and at least one angled face, a first and second extension positioned on opposing ends of the selector core, each comprising an extension aperture, and wherein the elongated section is positioned between the first and the second extensions, a plurality of levers, each comprising: a proximal and distal end, a recess for receiving one of the first and the second extension, a pin aperture, a pin, wherein at least a portion of the pin can pass through the first pin aperture and the extension aperture, and wherein rotation of the levers to a first position enables firing of the firearm and rotation to a second position precludes firing of the firearm.

19 Claims, 28 Drawing Sheets

(56) References Cited

U.S. PATENT DOCUMENTS

| | | | | |
|---|---|---|---|---|
| 3,442,173 | A * | 5/1969 | Muller | F41A 19/21 42/105 |
| 8,276,502 | B1 * | 10/2012 | Wright | F41A 35/06 42/70.08 |
| 8,499,482 | B1 * | 8/2013 | Di Trolio | F41A 35/06 42/70.01 |
| 8,549,982 | B2 * | 10/2013 | Troy, Jr. | F41A 19/33 89/132 |
| 8,806,790 | B1 * | 8/2014 | Huang | F41A 17/74 42/70.08 |
| 9,587,897 | B1 * | 3/2017 | Huang | F41A 17/70 |
| 10,126,081 | B1 | 11/2018 | Geissele | |
| 10,670,367 | B1 * | 6/2020 | Boyer | F41A 35/06 |
| 10,746,489 | B1 * | 8/2020 | Huang | F41A 17/46 |
| 11,175,109 | B1 * | 11/2021 | Lee | F41A 35/06 |
| 11,293,715 | B1 * | 4/2022 | Newsome | F41A 3/22 |
| 11,340,034 | B1 * | 5/2022 | Yudys | F41A 35/06 |
| 11,473,869 | B1 * | 10/2022 | Brandt | F41A 35/00 |
| 2007/0180984 | A1 * | 8/2007 | Huther | F41A 17/74 89/148 |
| 2012/0325044 | A1 * | 12/2012 | Brown | F41A 19/33 74/548 |
| 2013/0111796 | A1 * | 5/2013 | Dionne | F41A 17/00 42/70.11 |
| 2016/0187090 | A1 | 6/2016 | Mather et al. | |
| 2017/0176122 | A1 * | 6/2017 | Underwood | F41A 11/00 |
| 2017/0299304 | A1 * | 10/2017 | Otte, Jr. | F41A 17/46 |
| 2019/0128630 | A1 * | 5/2019 | Geissele | F41A 19/46 |
| 2020/0025486 | A1 | 1/2020 | Zung et al. | |
| 2020/0033088 | A1 * | 1/2020 | Nguyen | F41A 19/46 |
| 2020/0116447 | A1 * | 4/2020 | Geissele | F41A 17/46 |
| 2023/0288159 | A1 * | 9/2023 | Kastrun | F41A 19/46 |

OTHER PUBLICATIONS

International PCT Patent Application No. PCT/US2022/053374, filed Dec. 19, 2022. First named inventor: Lynch. International Search Report dated Mar. 22, 2023. 2 pages.

International PCT Patent Application No. PCT/US2022/053374, filed Dec. 19, 2022. First named inventor: Lynch. Written Opinion of the International Searching Authority dated Mar. 22, 2023. 4 pages.

* cited by examiner

MODULAR AR-TYPE SAFETY SELECTOR WITH LEVER MOUNTING PINS

CROSS-REFERENCE TO RELATED APPLICATIONS

The present application is the United States National Phase of International Patent Application No. PCT/US2022/053374, entitled "Modular AR-Type Safety Selector With Lever Mounting Pins," filed Dec. 19, 2022, which claims priority to U.S. Provisional Application No. 63/291,720, entitled "Modular AR-Type Safety Selector With Lever Mounting Pins," filed Dec. 20, 2021, the contents of each said application are incorporated herein by reference in their entirety and for all practical purposes.

FIELD OF THE DISCLOSURE

The present disclosure relates generally to safety selector levers for firearms. In particular, but not by way of limitation, the present disclosure relates to systems, methods and apparatuses for tool-less securing of a safety selector lever to a selector core.

DESCRIPTION OF RELATED ART

Manually operated safety levers and firing mode selectors are ubiquitous and included on most firearms. Aftermarket selector levers (or safety selector levers) for the AR-15/M16 platform are a prime example and have seen many innovations in the areas of ergonomics and ease of attachment/removal. For instance, many ambidextrous levers have been devised, changes to lever geometry (e.g., shape, size, orientation, etc.) have been developed, and adjustments to the degrees of lever throw (typically shorter than the standard 90°) have been implemented.

However, many of these designs continue to use traditional pinned, or screw-type attachment means. In some circumstances, such pinned levers are difficult to mount on firearms without a set of roll pin punches and a vice, or other applicable tools. Some pinned levers are also susceptible to damage when the firearm is in operation (e.g., from errant hammer strikes or punch slippage). Some safety lever designs, such as those using screws, typically require a tool during install. Additionally, tools may also be needed during firearm operation, for instance, if looseness develops in the lever as a result of repeated use. Quick-change designs using spring-loaded detents, such as the Super Configurable Safety Selector from GEISSELE or the structure shown in U.S. Patent Publication No. 2017/0176122, often allow movement between the levers and the center barrel/cam. Yet other designs, such as the one described in U.S. Pat. No. 11,085,720 assigned to FORTIS MANUFACUTRING INC, use a keyed interface between the lever arms and the center barrel/cam.

Accordingly, there is a need for an ambidextrous safety selector having tool-less attachment that provides a low-tolerance interface to the firearm with no humanly-discernable play.

Currently used safety selectors also tend to not have a high-visibility marking indicating the current mode or state (e.g., Safe, Semi/Fire, or Auto for example) of the firearm. While notches, ribs, and/or pointers are common, they are often difficult to see. In some circumstances, users apply their own solution, such as via ink or paint, to add a high-visibility marking to selectors. However, these tend to lack durability and often lack the visual quality of a factory-applied marking.

There is therefore a need for a high-visibility marking solution for safety selectors that is not only durable, but also cost effective.

The description provided in the description of related art section should not be assumed to be prior art merely because it is mentioned in or associated with this section. The description of related art section may include information that describes one or more aspects of the subject technology.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

In some aspects, the techniques described herein relate to a safety selector lever assembly for a firearm, including: a selector core, wherein the selector core includes: a first elongated section having a curved face and at least one angled face; a first extension and a second extension, wherein the first extension and the second extension are positioned on opposing ends of the selector core; wherein each of the first extension and the second extension include an extension aperture, and wherein the first elongated section is positioned between the first and the second extensions; a plurality of levers, wherein each of the plurality of levers includes: a proximal end and a distal end; a first recess that is shaped and sized to receive one of the first extension and the second extension of the selector core, wherein the first recess is positioned at or near a proximal end of a corresponding lever; a first pin aperture positioned at the proximal end of the corresponding lever; a pin, wherein at least a portion of the pin is shaped and sized to be received in the first pin aperture and the corresponding extension aperture; wherein each of the plurality of levers is removably coupled to the selector core, and wherein rotation of at least one of the plurality of levers to a first position enables firing of the firearm while rotation of at least one of the plurality of levers to a second position precludes firing of the firearm.

In some aspects, the techniques described herein relate to a safety selector lever assembly, wherein each pin includes: a distal end having an inner notch and an outer notch; a proximal end having a head; and a shaft positioned between the head and the distal end.

In some aspects, the techniques described herein relate to a safety selector lever assembly, wherein each of the plurality of levers further includes: a second pin aperture positioned at the distal end of the corresponding first recess; and a pin recess, wherein the pin recess surrounds at least a portion of the first pin aperture; and wherein: the head of each pin is shaped and sized to be received within the corresponding pin recess; and the removable coupling of each of the plurality of levers with the selector core is based at least in part on the shaft of a corresponding pin passing through the first pin aperture, the extension aperture, and the second pin aperture.

In some aspects, the techniques described herein relate to a safety selector lever assembly, wherein: the inner notch and the outer notch include a different length, a different shape, a different depth, or a combination thereof.

In some aspects, the techniques described herein relate to a safety selector lever assembly, wherein the head of each pin is shaped to fit flush or substantially flush against one or more of: a receiver of the firearm; and the proximal end of a corresponding lever.

In some aspects, the techniques described herein relate to a safety selector lever assembly, wherein: the removable coupling of each of the plurality of levers with the selector core is based at least in part on the at least the portion of each pin passing through a respective one of the first extension and the second extension.

In some aspects, the techniques described herein relate to a safety selector lever assembly, wherein each of the plurality of levers further includes: a second pin aperture positioned at the proximal end of the corresponding first recess; a second recess, wherein the second recess is positioned between the first recess and the distal end of the corresponding lever; and wherein the second pin aperture connects the first recess and the second recess of the corresponding lever.

In some aspects, the techniques described herein relate to a safety selector lever assembly, wherein the second recess of at least one of the plurality of levers includes: a keyed detent, wherein the keyed detent is shaped and sized to be received within a notch of a corresponding pin when a distal end of the pin is pushed past the keyed detent.

In some aspects, the techniques described herein relate to a safety selector lever assembly, wherein the selector core further includes: a detent channel with a plurality of detent recesses positioned between the first elongated section and one of the first or second extensions, wherein the plurality of detent recesses are shaped and sized to receive an end of a detent pin to secure rotation of the selector core.

In some aspects, the techniques described herein relate to a safety selector lever assembly, wherein the detent pin includes a spring-loaded detent pin, and wherein: when the plurality of levers are in the first position, the end of the spring-loaded detent pin is biased into a first one of the detent recesses; and when the plurality of levers are in the second position, the end of the spring-loaded detent pin is biased into a second one of the detent recesses.

In some aspects, the techniques described herein relate to a safety selector lever assembly, wherein at least one of the plurality of levers and the plurality of pins includes a visual indicator to indicate a current state of the firearm, wherein the current state includes one of a FIRE state and a SAFE state.

In some aspects, the techniques described herein relate to a safety selector lever assembly, wherein, the plurality of levers include a first lever and a second lever, the first lever and the second lever positioned on opposing sides of a receiver of the firearm; and the selector core passes through the receiver.

In some aspects, the techniques described herein relate to a safety selector lever assembly, wherein the first lever and the second lever include one or more of: a different length; a different maximum depth or maximum height; and a different shape.

In some aspects, the techniques described herein relate to a safety selector lever assembly, wherein when in the first position, the first elongated section is oriented such that a trigger or sear of the firearm is pivotable to release a hammer of the firearm, or the trigger is movable in a linear direction, and wherein when in the second position, the first elongated section is oriented such that a trigger or sear of the firearm is prevented from rotating, or the trigger is prevented from moving in a linear direction.

In some aspects, the techniques described herein relate to a method of using a safety selector lever assembly for a firearm, including: inserting a selector core through an opening on a side of a receiver of the firearm, wherein the selector core includes: a first elongated section having a curved face and at least one angled face; a first extension, wherein the first extension is positioned at a first end of the selector core and protrudes through the opening on the side of the receiver; wherein the first extension includes a first extension aperture; removably coupling a first lever to the selector core, wherein the first lever includes a proximal end, a distal end, a first recess shaped and sized to receive the first extension of the selector core, a first pin aperture positioned at the proximal end, and a first detent, and wherein removably coupling the first lever to the selector core includes: positioning the first lever such that the first extension is received in the first recess of the first lever; inserting a distal end of a first pin through the first pin aperture of the first lever, wherein the first pin includes at least one notch; and pushing the first pin such that the distal end of the first pin passes through the first extension aperture and past the first detent of the first lever, wherein at least a portion of the first pin passes through the first extension, and wherein the first detent is received within one of the at least one notch of the first pin.

In some aspects, the techniques described herein relate to a method, wherein the selector core further includes: a second extension, wherein the second extension is positioned at a second end of the selector core, the second end opposing the first end, and wherein the second extension protrudes through another opening on an opposing side of the receiver; and wherein the second extension includes a second extension aperture.

In some aspects, the techniques described herein relate to a method, further including: removably coupling a second lever to the selector core, wherein the second lever includes a proximal end, a distal end, a first recess shaped and sized to receive the second extension of the selector core, a first pin aperture positioned at the proximal end, and a second detent, and wherein removably coupling the second lever to the selector core includes: positioning the second lever such that the second extension is received in the first recess of the second lever; inserting a distal end of a second pin through the first pin aperture of the second lever, wherein the second pin includes at least one notch; and pushing the second pin such that the distal end of the second pin passes through the second extension aperture and past the second detent of the second lever, wherein at least a portion of the second pin passes through the second extension, and wherein the second detent is received within one of the at least one notch of the second pin.

In some aspects, the techniques described herein relate to a method, further including: rotating at least one of the first lever and the second lever, and wherein rotation of at least one of the first lever and the second lever results in a corresponding rotation of the selector core, and wherein each of the first lever and the second lever is rotatable between a first position and a second position; wherein, when in the first position, the first elongated section is oriented to allow firing of the firearm; and wherein, when in the second position, the first elongated section is oriented to preclude firing of the firearm.

In some aspects, the techniques described herein relate to a firearm configured for a selectable fire rate, the firearm including: a receiver having at least one opening and a firing assembly; a safety selector lever assembly, the safety selector lever assembly including: a selector core having a first elongated section, and a first extension positioned at a first end of the selector core, wherein the first extension includes a first extension aperture and is shaped and sized to protrude the opening; and a lever removably coupled to the selector core, where the lever includes: a first recess that is shaped and sized to receive the first extension; a first pin aperture and a second pin aperture positioned on opposing ends of the first recess; a second recess including a keyed detent; and a pin including a notch; wherein removably coupling the lever to the selector core includes: inserting one end of the pin through the first pin aperture such that it passes through the first pin aperture, the extension aperture, and the second pin aperture, wherein at least a portion of the pin extends past the keyed detent and the keyed detent is received within the notch of the pin; and wherein rotation of the lever results in a corresponding rotation of the selector core, and wherein the lever is rotatable between a plurality of positions, each position resulting in a different orientation of the first elongated section with respect to the firing assembly.

In some aspects, the techniques described herein relate to a firearm, wherein the lever includes a through hole extending from the second recess to an outside of the lever for removal of the pin from the lever.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

Figure 1:
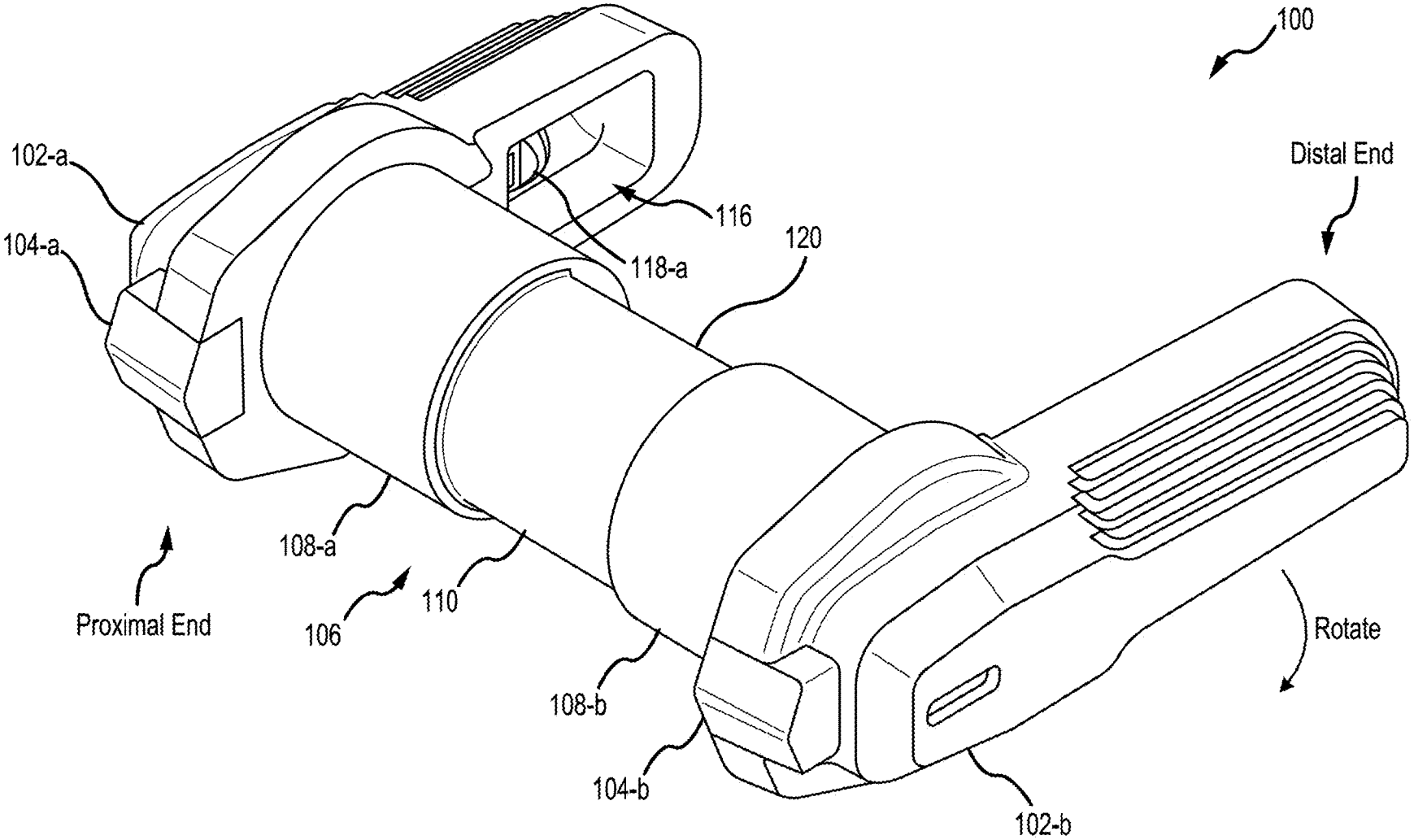
FIG. 1 illustrates a top perspective view of a safety selector lever assembly for a firearm, according to various aspects of the disclosure.

The present disclosure relates generally to a tool-less attachment of one or more safety selector levers to a selector core.

The word "exemplary" is used herein to mean "serving as an example, instance, or illustration." Any embodiment described herein as "exemplary" is not necessarily to be construed as preferred or advantageous over other embodiments.

Preliminary note: the flowcharts and block diagrams in the following Figures illustrate the functionality and operation of possible implementations of a safety selector lever assembly according to various embodiments of the present disclosure. It should be noted that, in some alternative implementations, the functions noted in each block may occur out of the order noted in the figures. For example, two blocks shown in succession may, in fact, be executed substantially concurrently, or the blocks may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Broadly, this disclosure describes a safety selector lever assembly, that may or may not be ambidextrous and includes at least one lever selectively fixed to a lever core (also referred to as a selector core) with minimal to no human-discernable play. In some embodiments, a pin (e.g., a polymer pin, a metal pin) with a keying structure can be inserted through the lever, even when the lever core is installed on the weapon, which allows for tool-less installation of the lever. To limit play between the lever and the selector core, one or more fit ribs (e.g., shown as ribs 2371 in FIG. 23) can be added and/or adjusted during manufacturing, further described in relation to the figures below. In some examples, the safety selector lever assembly may include a visual marking or indicator on one or more of the lever and the pin, which serves to enhance selector mode visibility. In this way, aspects of the present disclosure are directed to a low-cost safety selector lever assembly with enhanced selector mode visibility, as compared to the prior art.

FIG. 1 illustrates an embodiment of safety selector lever assembly 100, according to various aspects of the disclosure. Here, the safety selector lever assembly 100 is an example of an ambidextrous safety selector lever assembly comprising a plurality of levers 102 (e.g., levers 102-*a*, 102-*b*) coupled to a selector core 106. In some cases, the plurality of levers 102 are rotatably coupled to the selector core 106 by a plurality of keyed pins (also referred to as pins or retainers). In some cases, the levers 102-*a* and 102-*b* may be arranged on an outside of a firearm receiver (not shown) while the selector core 106 passes through the receiver. Furthermore, the levers 102-*a*, 102-*b* and the selector core 106 can be fixed to each other such that rotation of either lever 102-*a* or 102-*b* may cause a corresponding rotation of the selector core 106, lending to the ambidextrous nature of the safety selector lever assembly 100. For instance, the levers 102-*a* and/or 102-*b* can be rotated (or movable) between a first position and a second position, which causes the selector core 106 to also rotate. In some cases, the selector core 106 comprises one or more angled faces 120 (more clearly seen in FIG. 3) and a partially cylindrical section. The rotation of the selector core 106 may orient the angled face 120 down in a FIRE position such that the trigger or sear of the firearm is free to pivot (e.g., upwards) and release a hammer of the firearm. Similarly, when the selector core 106 is rotated into a SAFE position (i.e., based on the rotation of one or more of the levers 102-*a*, 102-*b*), the angled face 120 is oriented toward a rear of the firearm. In such cases, the partially-cylindrical section 110 of the selector 106 faces the back portion of the trigger or sear and prevents the trigger/sear from rotating sufficiently to release the hammer of the firearm. In some embodiments, the levers 102-*a* and/or 102-*b* and the selector core 106 may be rotatable between more than two positions. For instance, the levers 102-*a* and/or 102-*b* can be rotatable between three or more positions (e.g., first position=Safe, second position=Semi Auto, third position=Full Auto or first position=Safe, second position=Semi Auto, third position=Burst, fourth position=Full Auto, to name a few non-limiting examples).

In some embodiments, each of the levers 102-*a* and 102-*b* is configured to receive, or includes, a keyed pin 104 (e.g., keyed pins 104-*a* and 104-*b*, respectively).

Furthermore, although a semi-automatic version of the selector core 106 is shown, in alternative embodiments, a fully automatic selector core can be used. In one non-limiting example, this core includes a flange extending from the middle of the face 120 and includes a rectangular recess in one of the cylindrical sections (e.g., the left fully cylindrical section 108-*b*) that interfaces with the auto sear.

Figure 2:
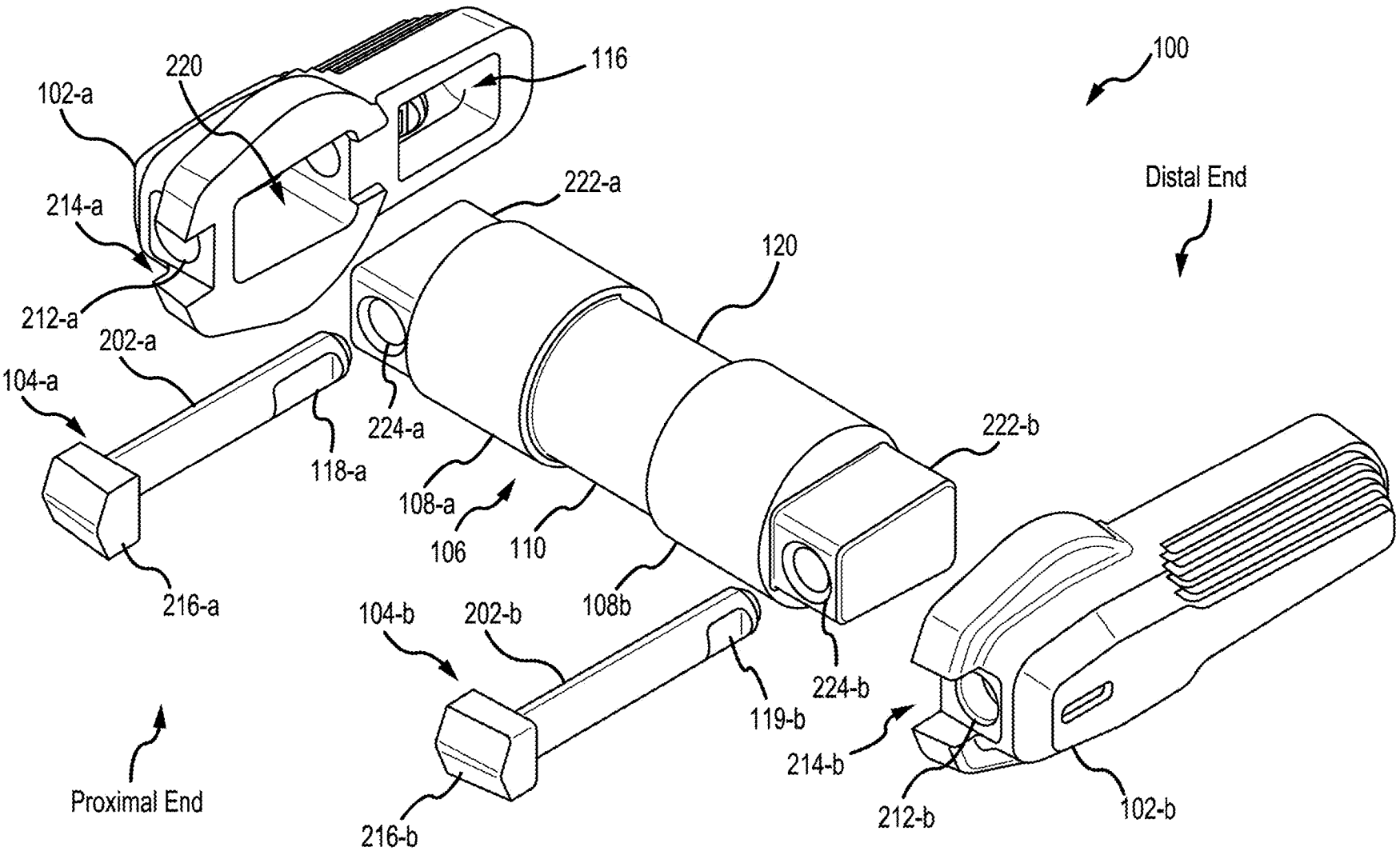
FIG. 2 illustrates an exploded view of the safety selector lever assembly in FIG. 1, according to various aspects of the disclosure.

FIG. 2 illustrates an exploded view of the safety selector lever assembly 100 in FIG. 1, according to various aspects of the disclosure. Specifically, FIG. 2 shows how the pins 104-*a* and 104-*b* interface/interact with the levers 102 and the selector core 106 to affix the levers 102-*a* and 102-*b* to the selector core 106. As seen, each of the levers 102 comprises a first recess 220 positioned at or near the proximal end of the corresponding lever, where the first recess 220 is shaped and sized to fit over an extension 222 of the selector core 106. In some cases, the selector core 106 comprises an elongated section having a partially cylindrical section 110 and one or more angled faces 120, two cylindrical sections 108-*a* and 108-*b* bounding the elongated section, and an extension 222 (e.g., extensions 222-*a*, 222-*b*) on each end of the selector core 106. In some cases, each extension 222 comprises an extension aperture 224 (e.g., extension apertures 224-*a*, 224-*b*). In this example, the first recess 220 of the lever 102-*a* is shaped and sized to receive the extension 222-*a*, while the first recess (not visible from this angle) of the lever 102-*b* is shaped and sized to receive the extension 222-*b*. In some cases, each lever 102 includes a first pin aperture 212 (e.g., pin apertures 212-*a*, 212-*b*), where each of the first pin apertures 212 is shaped and sized to receive at least a portion of one of the pins 104-*a* and 104-*b*. In some cases, the first pin aperture 212 of each lever 102 is positioned to be aligned or substantially aligned with a corresponding extension aperture when the extension is received within the first recess of the lever. This allows at least a portion of the pins 104-*a* and 104-*b* to pass through the first pin apertures 212-*a* and 212-*b* in levers 102-*a* and 102-*b*, respectively, as well as extension apertures 224-*a* and 224-*b* of extensions 222-*a* and 222-*b*, respectively. In some cases, each of the levers 102 further includes a second pin aperture, where the second pin aperture is positioned on an opposing side of the first recess. In some cases, at least a portion of the pins 104-*a* and 104-*b* passes through a respective second pin aperture and partially extends into a second recess of a respective lever. The second pin aperture connects the first and the second recesses of a respective lever. Thus, the pins 104-*a* and 104-*b* pass entirely through the selector core 106, which helps secure the levers 102-*a* and 102-*b* to the selector core. In some cases, each of the pins 104 comprises at least one notch that is shaped and sized to interface with a keyed detent in the second recess, further described in relation to figures below. The interaction of the keyed detents and notches helps secure the pins to the respective levers. This design allows tool-less attachment of the levers 102-*a* and 102-*b* to the selector core 106. In some cases, removal of the pins 104 from the levers 102, for instance, for disassembly, may also be tool-less. In some circumstances, however, a rear of the levers 102-*a* and 102-*b* may include a small hole (shown in FIG. 3) that allows a thin object such as a pin, paperclip, etc., to be inserted to push the keyed pin 104-*a* and 104-*b* out of the front of the lever 102-*a* and 102-*b* far enough for a user to grab the keyed pin 104-*a* and 104-*b* and complete the removal. It should be noted that, this hole at the rear end of the levers 102-*a* and 102-*b* may be optional in some embodiments.

As seen in FIG. 2, each pin 104 (e.g., pin 104-*a*, pin 104-*b*) includes a head 216 (e.g., head 216-*a*, head 216-*b*) and a shaft 202 (e.g., shaft 202-*a*, shaft 202-*b*). Each shaft 202 stretches from the head 216 to a distal end of a respective pin 104. In some embodiments, each lever 102 includes a pin recess 214 (e.g., pin recess 214-*a*, pin recess 214-*b*) positioned at or near the front/distal end of the lever, where the pin recess 214 partially (or completely) surrounds the first pin aperture. The pin recess 214 is shaped and sized to receive the head 216 of a corresponding pin. Specifically, each of the heads 216-*a* and 216-*b* fits into a corresponding pin recess 214-*a* and 214-*b* in the levers 102-*a* and 102-*b* and prevents the pins 104-*a* and 104-*b* from passing too far into the levers 102-*a* and 102-*b*.

In some embodiments, a distal end of each pin 104-*a* and 104-*b* has two notches: an inner notch 118 (e.g., inner notch 118-*a*, inner notch 118-*b*) and an outer notch 119 (e.g., outer notch 119-*a*, outer notch 119-*b*). In some embodiments, the inner notch 118-*a* and 118-*b* may be longer than the outer notch 119-*a* and 119-*b*, though these roles/dimensions can also be reversed. In some cases, the outer notches 119-*a* and 119-*b* are shaped to be longer than a width of the keying detents (e.g., shown as keying detent 302 in FIG. 3; see FIG. 6B) in each of the levers 102-*a* and 102-*b*. As the pins 104-*a* and 104-*b* are pushed in through the front/proximal end of the levers and reach the keying detents 302, the keying detents 302 push against a distal end of the pins 104-*a* and 104-*b* causing the distal end of the pins 104 to flex slightly inward (in part due to the combination of the notches 118-*a*, 118-*b*, 119-*a*, and 119-*b* creating a narrow and weak point in the pins 104-*a* and 104-*b* that more easily flex than other regions along a length of the pins 104-*a* and 104-*b*). This bending allows the distal ends of the pins 104-*a* and 104-*b* to pass the keying detents 302 and for the keying detents 302 to enter the outer notches 119-*a* and 119-*b*. Upon entering the outer notches 119-*a* and 119-*b*, the pins 104-*a* and 104-*b* return to their steady state bending, or lack thereof, and in this way lock the pins 104-*a* and 104-*b* in place until sufficient force is applied to again bend the pins 104-*a* and 104-*b* and allow the keying detent 402 to escape the outer notches 119-*a* and 119-*b*. In some embodiments, and as shown in FIG. 6B, the position of a distal end of each of the outer notches 119-*a* and 119-*b* can be selected so as to be positioned along a front edge of the corresponding keying detent 302.

The distal edge of the outer notches 119-*a* and 119-*b* can be angled as can be the sides of the keying detents 402 and these angles can be flush to each other. As can be appreciated, this flush angled interface facilitates easier insertion and/or removal of the pins 104-*a* and 104-*b*. Alternatively, the length of the outer notches 119-*a* and 119-*b* can be selected so that little room in the outer notches 119-*a* and 119-*b* exists on either side of the keying detents 402 and in this way, there is little play between the pins 104-*a* and 104-*b* and the corresponding levers 102-*a* and 102-*b*.

In the illustrated embodiment, the heads 216-*a* and 216-*b* of the pins 104-*a* and 104-*b* are shaped to fit flush, or nearly flush, against a side of a firearm receiver (not shown) and/or flush, or nearly flush, against an inner face of the levers 102-*a* and 102-*b* which helps prevent the pins 104-*a* and 104-*b* for being accidentally removed.

In some embodiments, the levers 102-*a* and 102-*b* can also include receiving notches 220 that are shaped to snuggly receive the extensions 222-*a* and 222-*b*, respectively, of the selector core 106. In some embodiments, the extensions 222-*a* and 222-*b* may comprise any type of quadrilateral shape, such as, but not limited to, a rectangle, a square, a rhombus, a parallelogram, a trapezoid, and a kite.

A notch 116 (i.e., second recess 116) in each lever 102-*a* and 102-*b* can house the keying detents 302 and, when the pins 104-*a* and 104-*b* are inserted, the distal ends of the pins 104-*a* and 104-*b* can pass into and rest within the notch 116 (or second recess 116).

In some embodiments, one or more of the levers 104-*a* and 104-*b* and the pins 104-*a* and 104-*b* may comprise a visual marking or indicator. For instances, at least a portion of the pins 104-*a* and/or 104-*b* may be colored using a highly visible color like orange or red, which enhances the visibility of the assembly's state (i.e., state of the firearm, such as FIRE or SAFE). In some examples, only the heads 216-*a* and/or 216-*b* of the pins 104 may be visible when the safety selector lever assembly is installed in a firearm receiver. In such cases, the colored heads 216-*a* and/or 216-*b* may serve as an arrow or pointer to help point to a state on the receiver, often embossed as SAFE or FIRE on the receiver, or symbols representing these states.

As noted above, the selector core 106 can be an elongated structure with a circular cross section throughout most of its length. Alternatively, this can be referred to as a cylindrical shape. In some examples, the selector core 106 may have two fully cylindrical sections 108-*a* and 108-*b* bounding an inner partially cylindrical section 110 (also referred to as elongated section 110). The partially cylindrical section 110 may include the one or more angled faces 120. Additionally, the cylindrical portion of the partially cylindrical section 110 may have a first radius, where the first radius is smaller than a second radius of each of the two fully cylindrical sections 108-*a* and 108-*b*, as depicted in at least FIGS. 2-5.

One or both of the fully cylindrical sections 108 (e.g., cylindrical sections 108-*a* and/or 108-*b*) can include a detent channel 310 that wraps around part of a circumference of the fully cylindrical section 108. Each detent channel 310 can wrap around a portion (e.g., 90°, or some angle between 45° and 90°, such as 75° or) 60° of the outer circumference of a respective cylindrical section 108 (e.g., fully cylindrical section 108-*a* or 108-*b*). As an example, the detent channel 310 can wrap from a 3 o'clock to a 6 o'clock position when viewing the lever 102 from the side. The ends of the detent channel 310 can each include a detent recess 306 and 308 (see FIG. 3) that is shaped to accept an end of a spring-loaded detent pin (e.g., shown as spring-loaded detent pin 702 in FIG. 7) in the firearm receiver. This spring-loaded detent pin 702 can be biased into either of the detent recesses 306 or 308 to secure rotation of the selector core 106 (i.e., in one of the FIRE and SAFE position). In some cases, these detent recesses 306 and 308 can be shallow enough and/or have angled sides shaped to mimic angles at an end of the spring-loaded detent pin, which allows the spring-loaded detent pin 702 to be back driven out of the detent recesses 306 and 308 with a nominal amount of user torque on either lever 102-*a* or 102-*b*. However, it should be noted that these angles and/or recess depths can be adjusted to afford different levels of resistance of the spring-loaded detent pin to being back driven.

Figure 3:
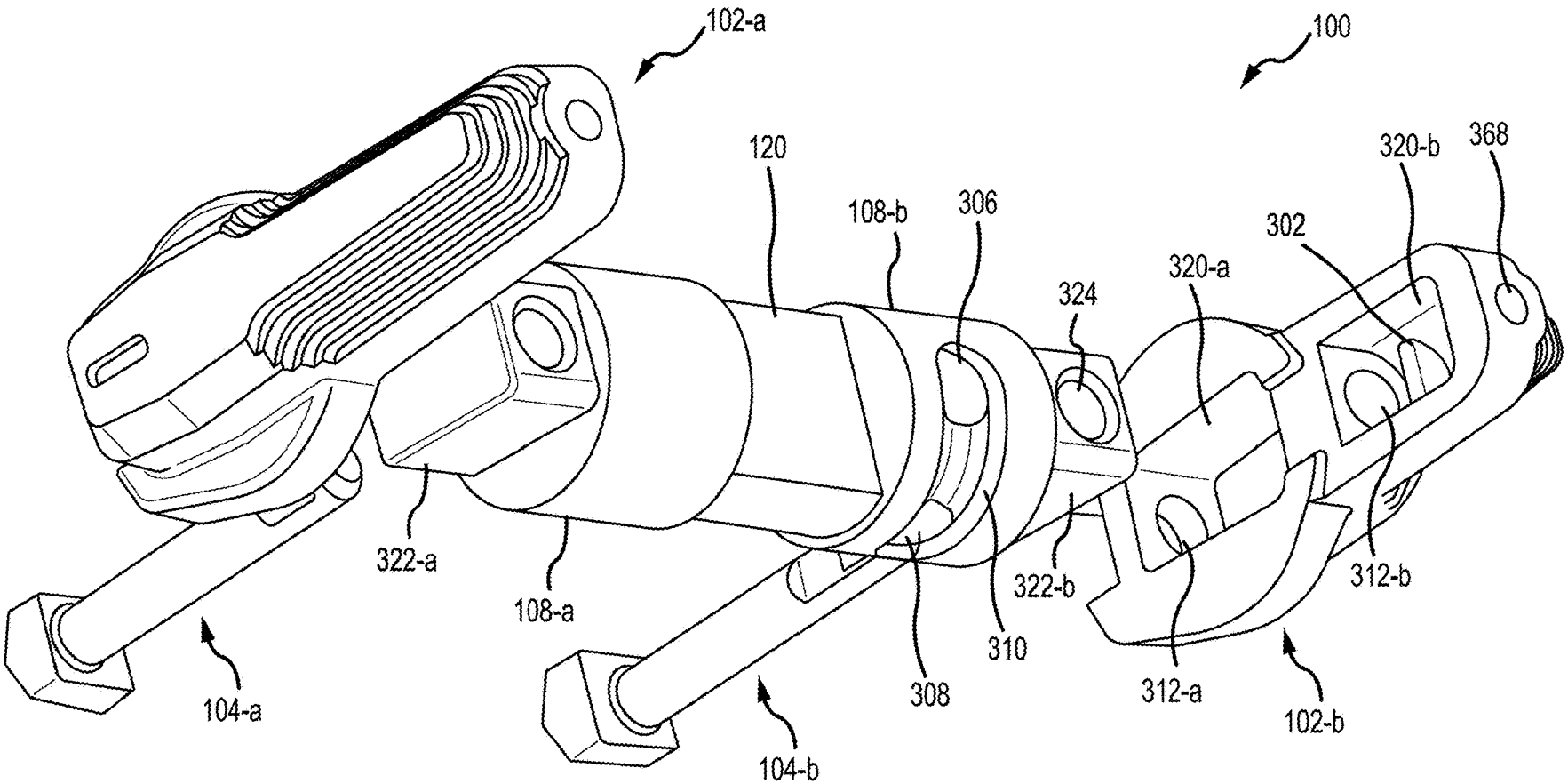
FIG. 3 illustrates another exploded view of the safety selector lever assembly in FIG. 1, according to various aspects of the disclosure.

FIG. 3 illustrates another exploded view of the safety selector lever assembly in FIG. 1, according to various aspects of the disclosure. As seen, the safety selector lever assembly 100 comprises a first lever 102-*a* having a pin 104-*a*, a second lever 102-*b* having a pin 104-*b*, and a selector core. The selector core comprises an elongated section (or partially cylindrical section) having at least one angled face 120, two cylindrical sections 108-*a*, 108-*b* bounding the elongated section, and extensions 322-*a*, 322-*b* at opposing ends of the selector core. As seen, each extension 322 comprises an extension aperture 324 that is shaped and sized to receive at least a portion (e.g., elongated shaft, shown as shaft 202 in FIGS. 2 and 4) of a respective pin 104. In this view, the lever 102-*b* comprises a first recess 320-*a*, a second recess 320-*b*, a first pin aperture 312-*a* positioned at a proximal end of the first recess 320-*a*, a second pin aperture 312-*b* connecting the first and the second recess, a keyed detent 302 in the second recess, and a through hole 368 at a distal end of the lever 102-*b*. In some cases, the lever 102-*a* may be similar or substantially similar to the first lever.

Figure 4:
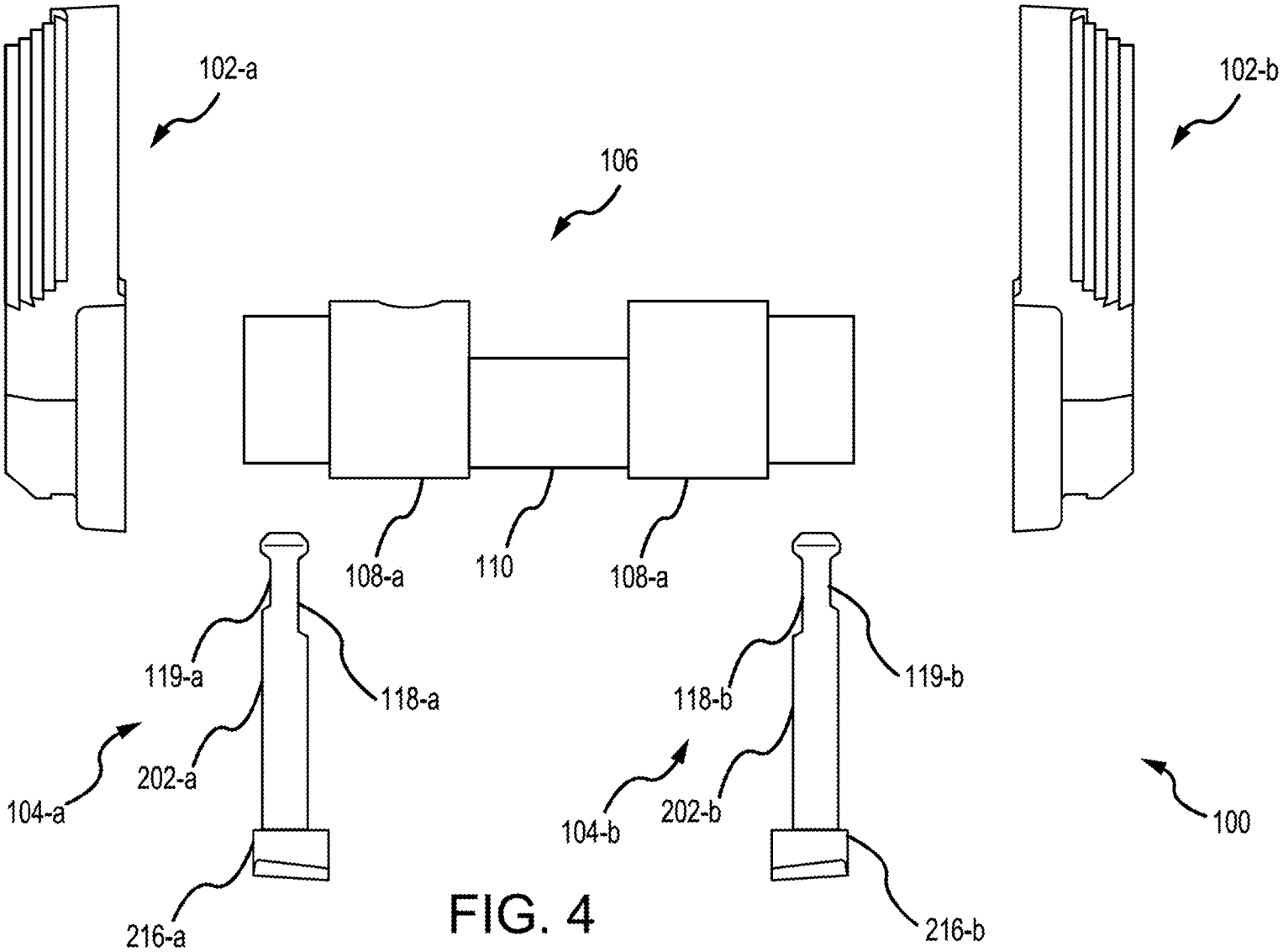
FIG. 4 illustrates a top/bottom view of various components of the safety selector lever assembly in FIG. 1, according to various aspects of the disclosure.

FIG. 4 illustrates a top view of various components of the safety selector lever assembly in FIG. 1, according to an embodiment of the disclosure. As seen in FIG. 4, in some embodiments, the levers 102-*a* and 102-*b* can have the same or similar dimensions (e.g., length, maximum depth or height, shape, to name a few).

Figure 5:
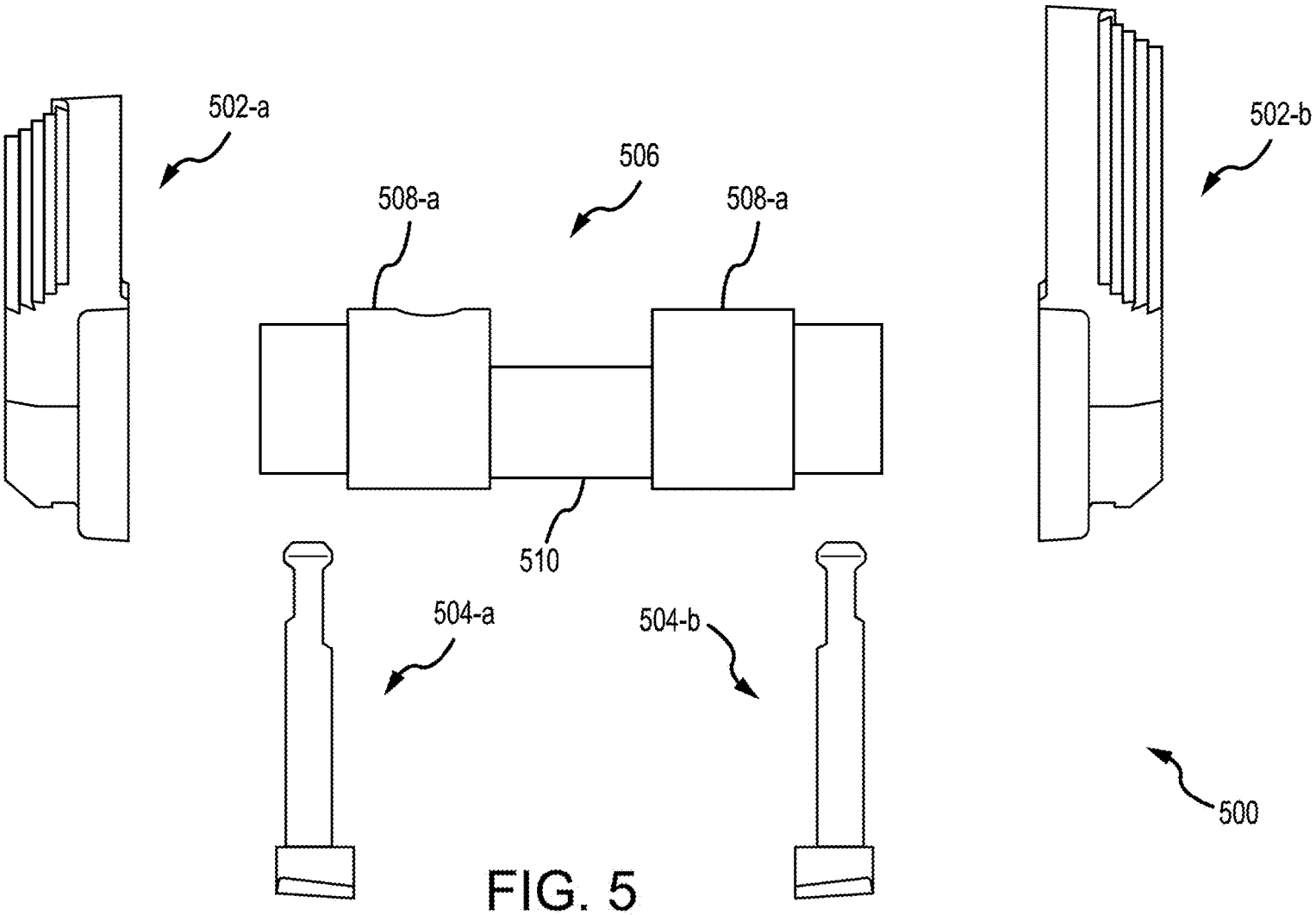
FIG. 5 illustrates a top view of various components of a safety selector lever assembly, according to various aspects of the disclosure.

FIG. 5 illustrates a top view of various components of a safety selector lever assembly 500, according to an alternate embodiment of the disclosure. The safety selector lever assembly 500 may implement one or more aspects of the safety selector lever assemblies described herein, including at least safety selector lever assembly 100 described in relation to FIG. 1. The safety selector lever assembly 500 comprises a selector core 506, a plurality of levers 502, and a plurality of pins 504 (or retainers 504). The selector core 506, the plurality of pins 504, and at least one of the plurality of levers 502 may be similar or substantially similar to the respective ones described above in relation to FIGS. 1-4. As seen in FIG. 5, in some embodiments, the levers may have different dimensions (e.g., different length, different maximum depth or height). In this example, the left lever 502-*a* is of a shorter length than the right lever 502-*b*. In some cases, the pins 504 may be identical or substantially identical to each other (e.g., have the same or similar length, similar notch dimensions, etc.). In other cases, however, the pins 504 may not be identical. For example, the pin 504-*a* inserted into the left lever 504-*a* may be shorter in length than the pin 504-*b* inserted into the right lever 504-*b*.

Figure 6A:
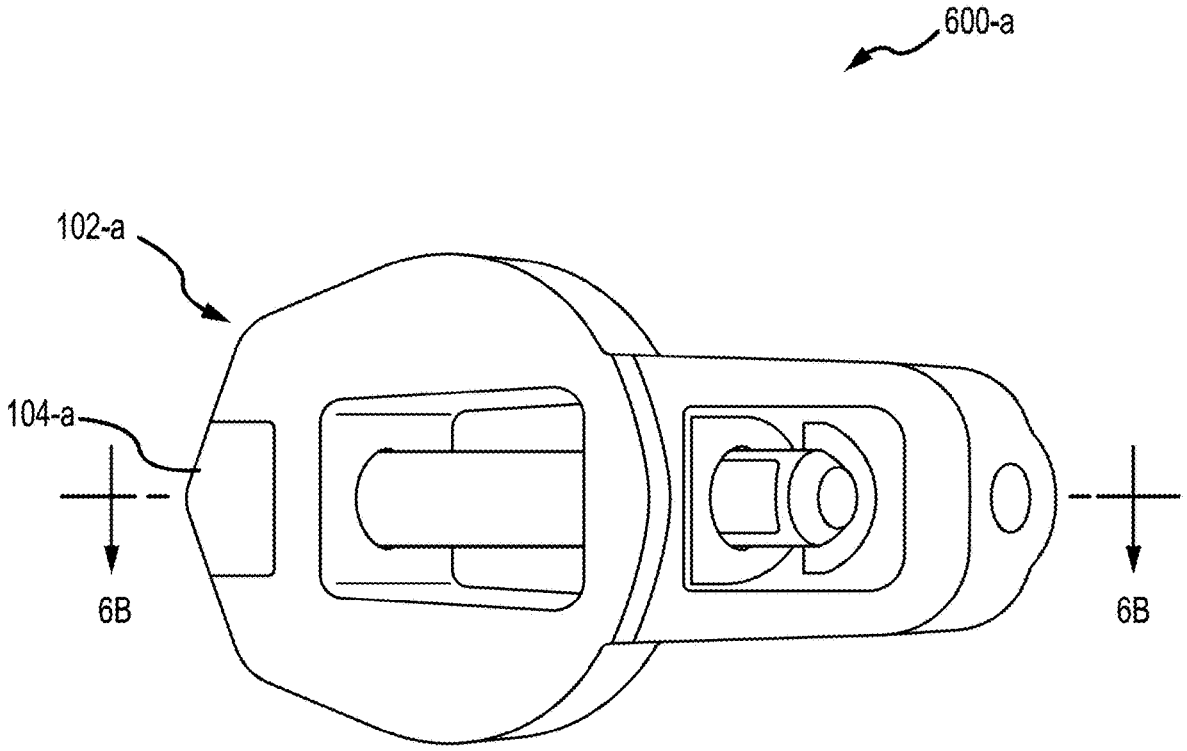
FIG. 6A illustrates a side view of a lever and pin of a safety selector lever assembly, according to various aspects of the disclosure.
Figure 6B:
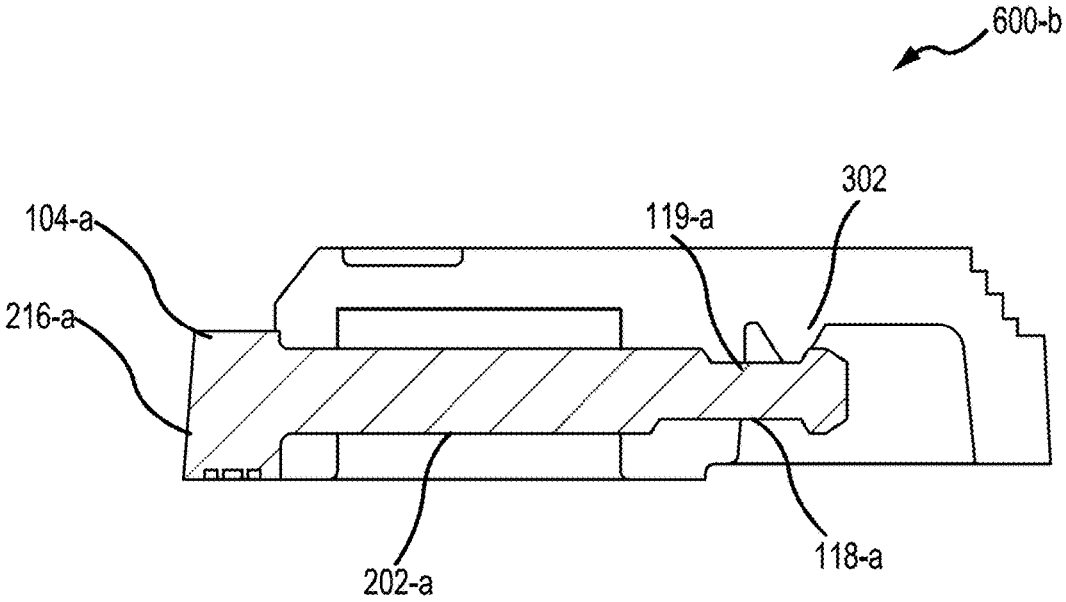
FIG. 6B illustrates a cross-sectional view of the lever and pin in FIG. 6A, according to various aspects of the disclosure.

FIG. 6A illustrates a side view 600-*a* of a lever and pin of a safety selector lever assembly, according to various aspects of the disclosure. Specifically, FIG. 6A shows a detailed and isolated view of the right lever 102-*a* and the corresponding pin 104-*a* (or retainer 104-*a*) of the safety selector lever assembly 100.

FIG. 6B illustrates a cross-sectional view 600-*b* of the lever 102-*a* and pin 104-*a* in FIG. 6A, according to various aspects of the disclosure. As seen in the cross-section view presented in FIG. 6B, the outer notch 119-*a* of the lever 102-*a* can be shaped and positioned such that the keying detent 302 rests just behind a distal end of the pin 104-*a*. In some circumstances, tension may be created between the proximal and distal ends of the pin 104-*a* as a result of the head 216-*a* pressing against the distal end of the pin recess and the position of the keying detent 302 within the outer notch 119-*a*, which helps minimize or reduce any wobble (or play) in the attachment of the lever 102-*a* to the selector core 106. It should be noted that similar principles may apply with regards to the attachment of the other lever (i.e., left lever 102-*b*) to the selector core 106.

Figure 7:
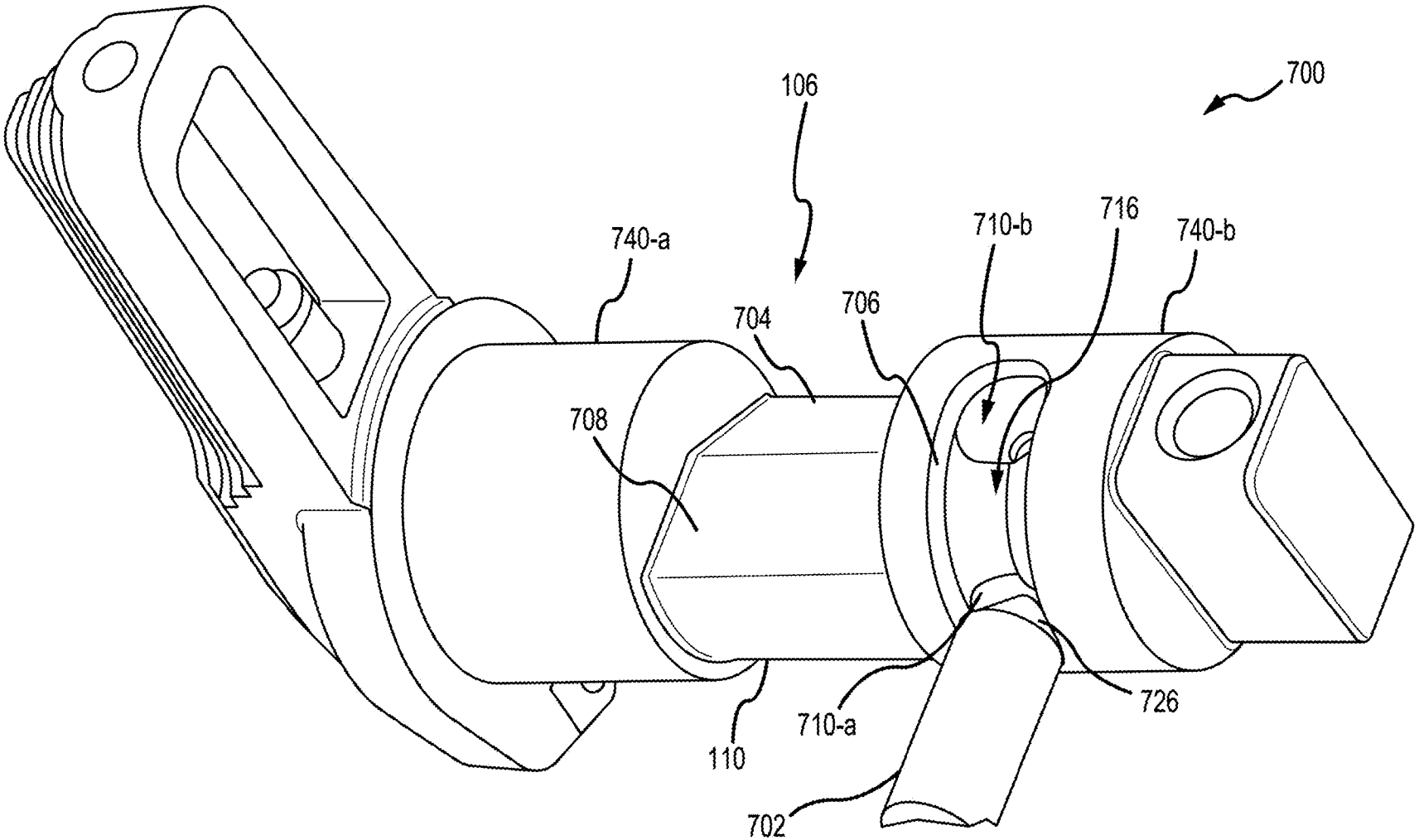
FIG. 7 illustrates a detailed bottom perspective view of a selector core and spring-detent pin of a safety selector lever assembly, according to various aspects of the disclosure.

FIG. 7 illustrates a detailed bottom perspective view of a selector core 106 and spring-detent pin 702 of a safety selector lever assembly 700, according to various aspects of the disclosure. The safety selector lever assembly 700 (or simply, selector lever assembly 700) may be similar or substantially similar to the safety selector lever assembly 100 described in relation to FIG. 1. FIG. 7 shows the selector lever assembly 700 comprising the selector core 106 having an elongated section (or partially cylindrical section) having a plurality of angled faces 704, 708. The selector core 106 further comprises two fully cylindrical sections positioned on either side of the elongated section, where at least one of the cylindrical sections comprises a detent channel 706. In some embodiments, the second cylindrical section may also comprise a detent channel (not visible from this angle). In some cases, each of the two angled faces 704 and 708 may correspond to a different one of the two detent channels 706. For example, the detent channel 706 (i.e., of the first or right cylindrical section) that is visible in FIG. 7 may correspond to one of the two angled faces (e.g., face 708), while the other detent channel (i.e., of the second or left cylindrical section) may correspond to the other of the two angled faces (e.g., face 704). FIG. 7 also shows the spring-loaded detent pin 702, where the spring-loaded detent pin 702 is biased into one of two detent recesses 710 in a first detent channel 706 of the two detent channels. In this example, the lever closest to the detent channel 706 is hidden to enhance visibility of the detent pin 702 and its interaction with the detent channel 706 and detent recess 710.

In some examples, the spring-loaded detent pin 702 comprises an elongated cylindrical section and a tip 726 (e.g., a conical tip), where the tip 726 is shaped and sized to be received within the detent recesses 710. In this example, each of the two detent recesses 710 also comprise a conical/pyramidal shape that largely resembles the conical tip 726 of the spring-loaded detent pin 702. The detent channel 706 also comprises an internal channel 716 between the two detent recesses 710. A width of the internal channel 716 may be roughly equal to a width of the conical tip of the detent pin 702, which allows the detent pin 702 to move between the lower and upper detent recesses 710-*a* and 710-*b*, respectively, of the detent channel 706 as the lever(s) 104 and selector core 106 are rotated. For example, the tip of the detent pin 702 may be positioned in the first/lower detent recess 710-*a* when the lever(s) are in a first position and the firearm receiver is in the FIRE state. Further, when the lever(s) are rotated towards a second position, the spring-loaded detent pin 702 is back driven, which causes the tip of the pin 702 to be pushed out of the first/lower detent recess 710-*a*. As noted above, rotation of the lever(s) causes a corresponding rotation in the selector core 106. In such cases, the cylindrical section comprising the detent channel 706 also rotates (e.g., downward), which allows the tip of the detent pin 702 to move through the internal channel 716 and into the second/upper detent recess 710-*b*, where it remains seated until the lever(s) are rotated again. In this example, the firearm receiver is in the SAFE state when the pin 702 is in the second/upper detent recess 710-*b*. In some cases, a similar or substantially similar spring-loaded detent pin may be provided for the second cylindrical section comprising the second detent channel 706.

FIGS. 8 through 11B illustrate additional views of a lever and its pin, according to an embodiment of the disclosure.

Figure 8B:
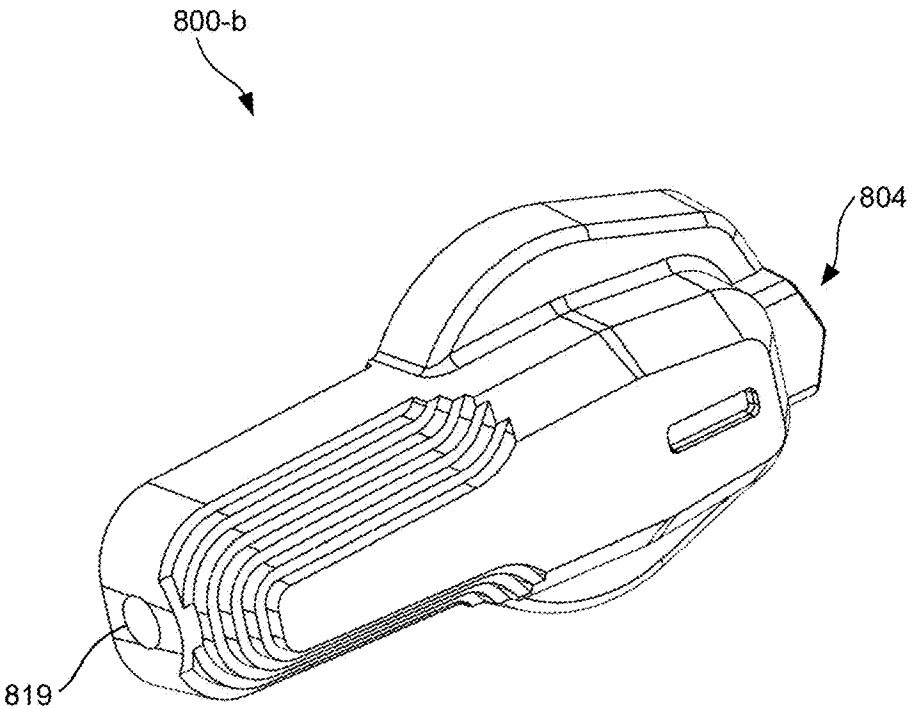
FIG. 8 illustrates a top perspective view of levers of a safety selector lever assembly, according to an embodiment of the disclosure.
Figure 8A:
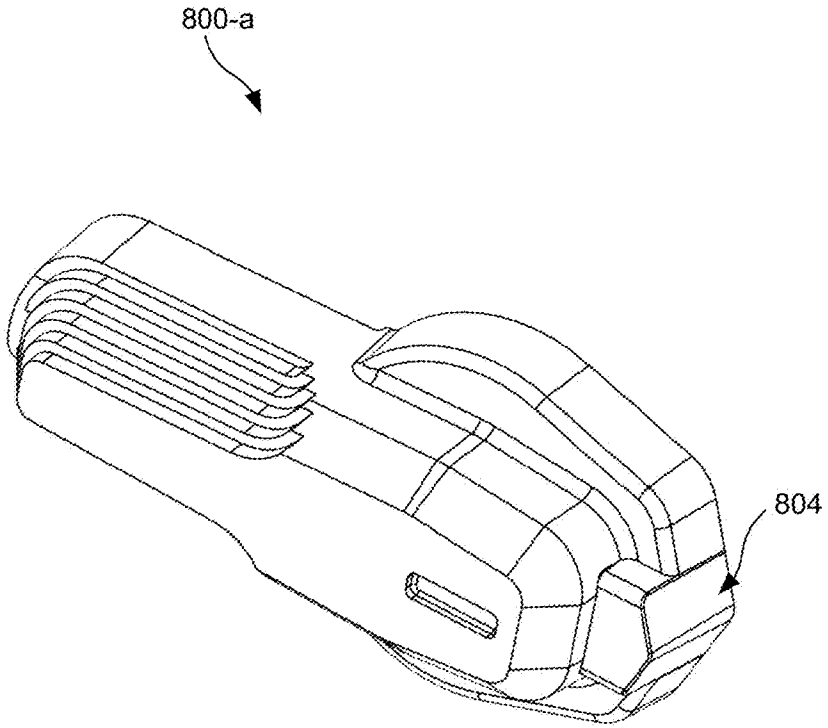

FIGS. 8A and 8B illustrates two top perspective views of levers 800-*a* and 800-*b*, respectively, of a safety selector lever assembly, according to an embodiment of the disclosure. The levers 800-*a* and 800-*b* may be similar or substantially similar to each other, or any of the other levers described herein. As seen, each lever 800 includes a pin 804 (or retainer 804). In some cases, the levers may comprise a through hole 819 positioned at one end that is opposing the end at which the pin 804 is inserted into the lever. This hole 819 may be shaped and sized to receive an object, such as, but not limited to, a paper clip, a safety pin, a nail, etc. In some instances, a user may insert the object (not shown) into the through hole to disengage the notch (e.g., notch 119-*a* in FIG. 6B) from the keyed detent (e.g., detent 302), which allows the user to pull the pin out from the lever and disassemble the safety selector lever assembly.

Figure 9B:
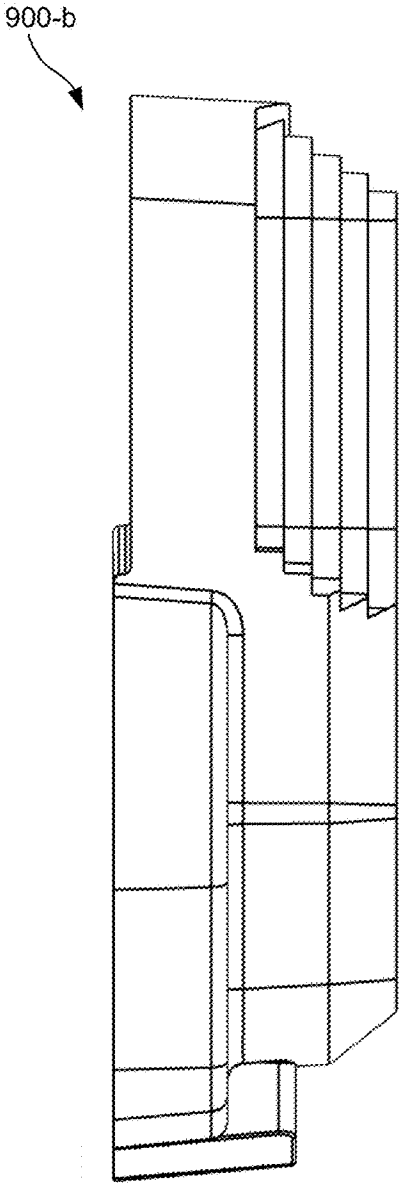
FIGS. 9A and 9B illustrate a top view of levers of a safety selector lever assembly, according to an embodiment of the disclosure.
Figure 9A:
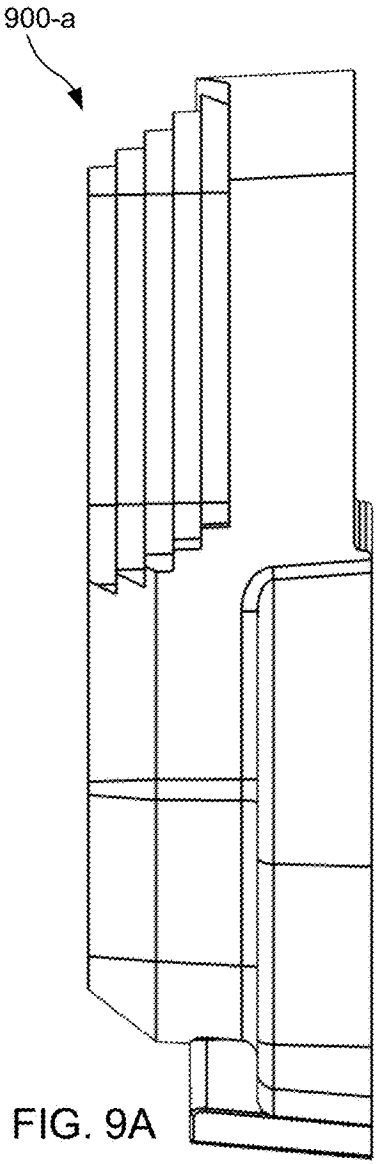

FIGS. 9A and 9B illustrates top views of levers 900-*a* and 900-*b* of a safety selector lever assembly, according to an embodiment of the disclosure. The levers 900-*a* and 900-*b* may be similar or substantially similar to the levers 102-*a* and 102-*b*, respectively, described above in relation to FIG. 1.

Figure 10A:
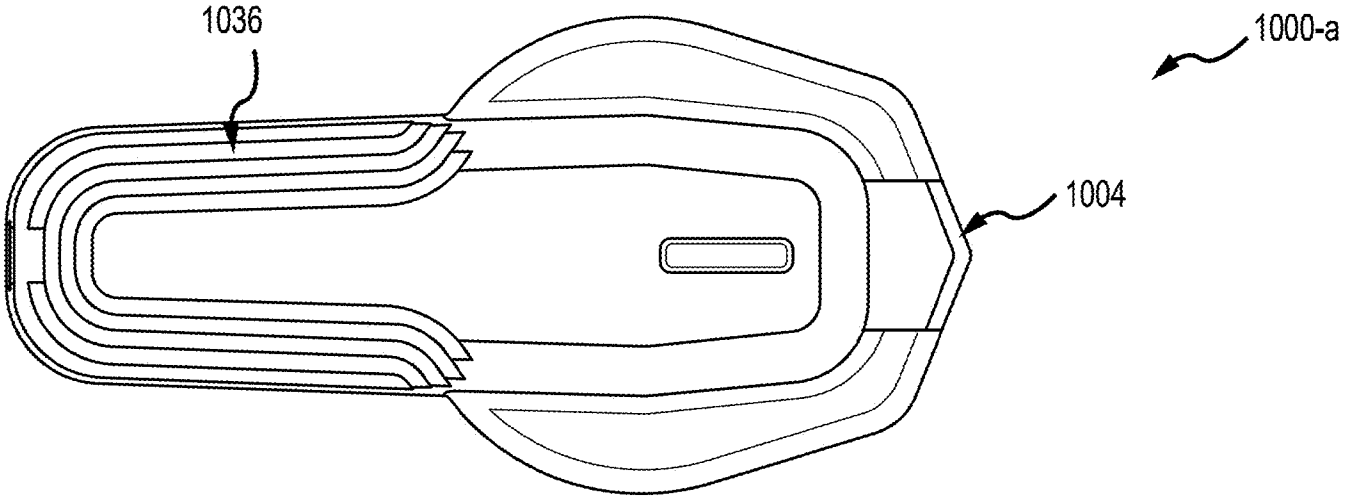
FIGS. 10A and 10B illustrate left and right-side views, respectively, of levers of a safety selector lever assembly, according to an embodiment of the disclosure.

FIG. 10A illustrates a right-side view of a lever 1000-*a* of a safety selector lever assembly, including its pin 1004, according to an embodiment of the disclosure. FIG. 10A depicts the external face of the lever (i.e., side of the lever that is visible when the safety selector lever assembly is installed in a firearm), including an example of a first pattern of ridges 1036.

Figure 10B:
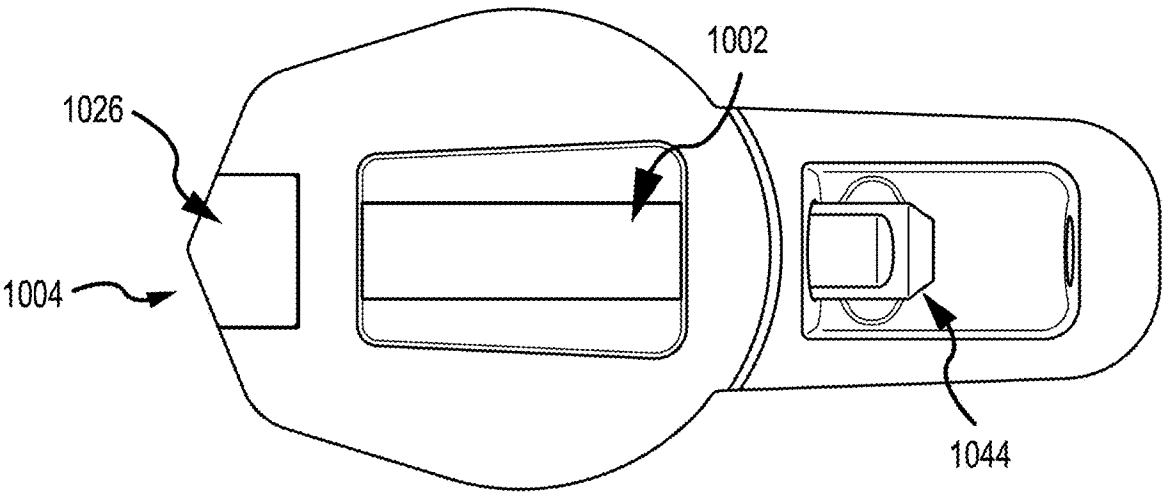

FIG. 10B illustrates a left-side view of the lever 1000-*a* in FIG. 10A, according to an embodiment of the disclosure. As seen, the lever 1000-*a* comprises the pin 1004, the pin 1004 having a head 1026 at a proximal end, a distal end 1044, and a shaft 1002 extending between the head 1026 and the distal end.

Figure 11B:
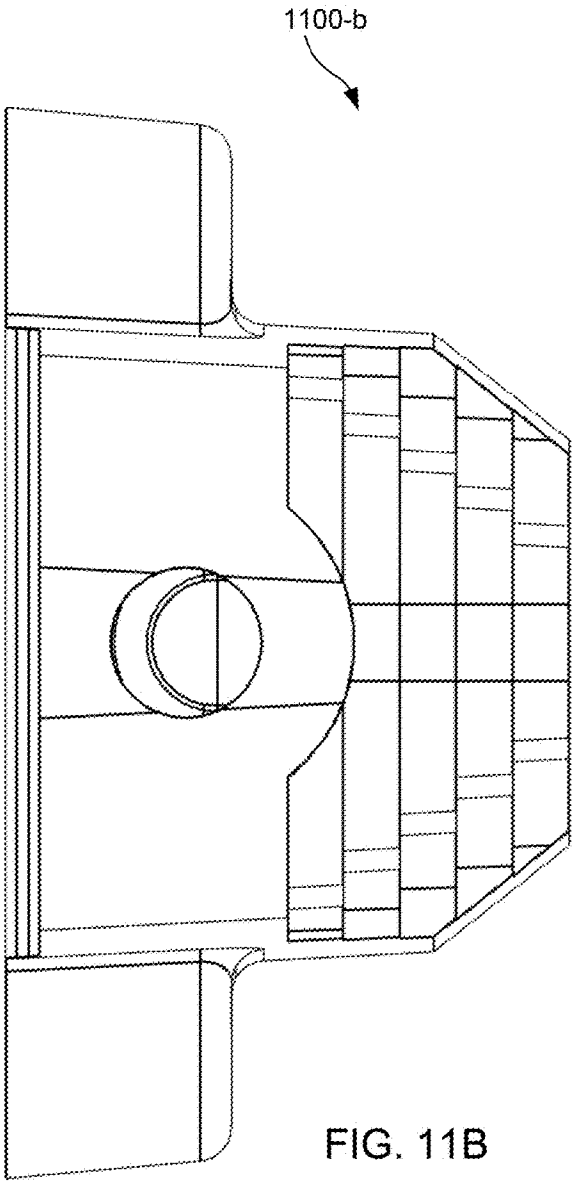
FIGS. 11A and 11B illustrate rear and front views, respectively, of levers of a safety selector lever assembly, according to an embodiment of the disclosure.
Figure 11A:
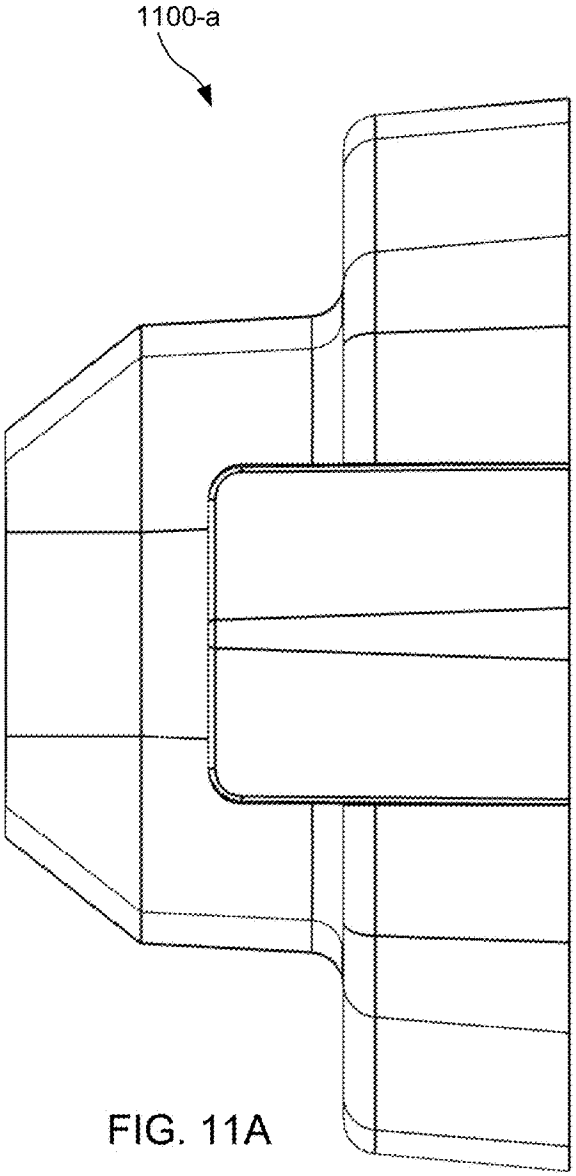

FIG. 11A illustrates a front view of a lever 1100-*a* of a safety selector lever assembly, according to an embodiment of the disclosure.

FIG. 11B illustrates a rear view 1100-*b* of a lever of a safety selector lever assembly, according to an embodiment of the disclosure.

FIGS. 12A-15B illustrate a hybrid selector lever, according to an alternate embodiment of the disclosure. In some cases, the hybrid selector lever (e.g., levers 1200-1500) include a shallower profile (i.e., as compared to the profile of the levers 800-1100) toward a rear of the lever and a removal pin hole (e.g., see removal pin hole 1502, also referred to as through hole 1502). In some embodiments, the through hole 1502 is offset from a longitudinal axis of the keyed pin to enable the shallower profile. As noted above, in some instances, a sharp object (e.g., nail, paper clip) can be inserted through this through hole 1502 to help push the keyed pin out of the lever during disassembly.

Figure 12B:
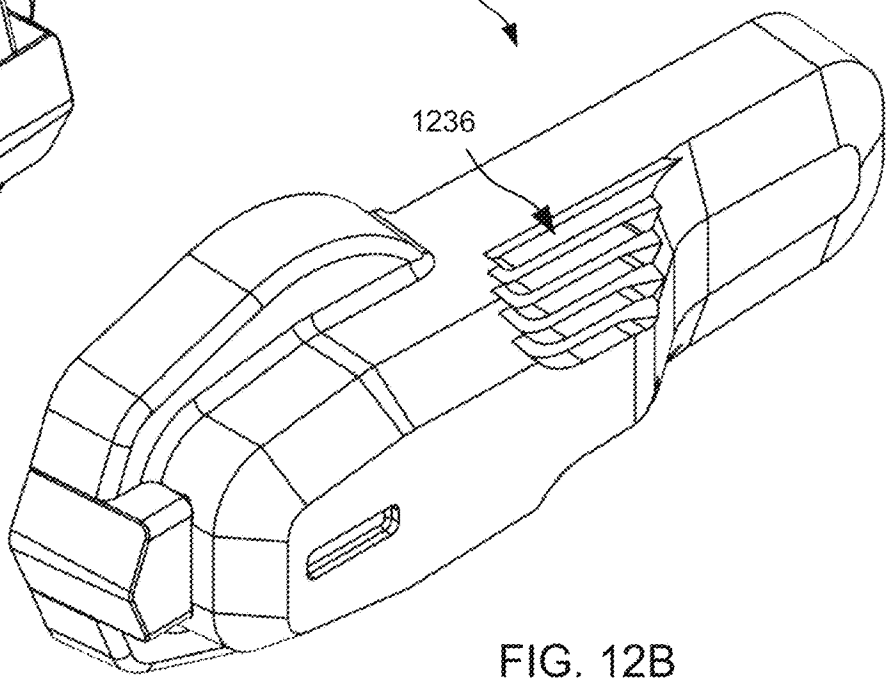
FIGS. 12A and 12B illustrate top perspective views of a lever of a safety selector lever assembly, according to an alternate embodiment of the disclosure.
Figure 12A:
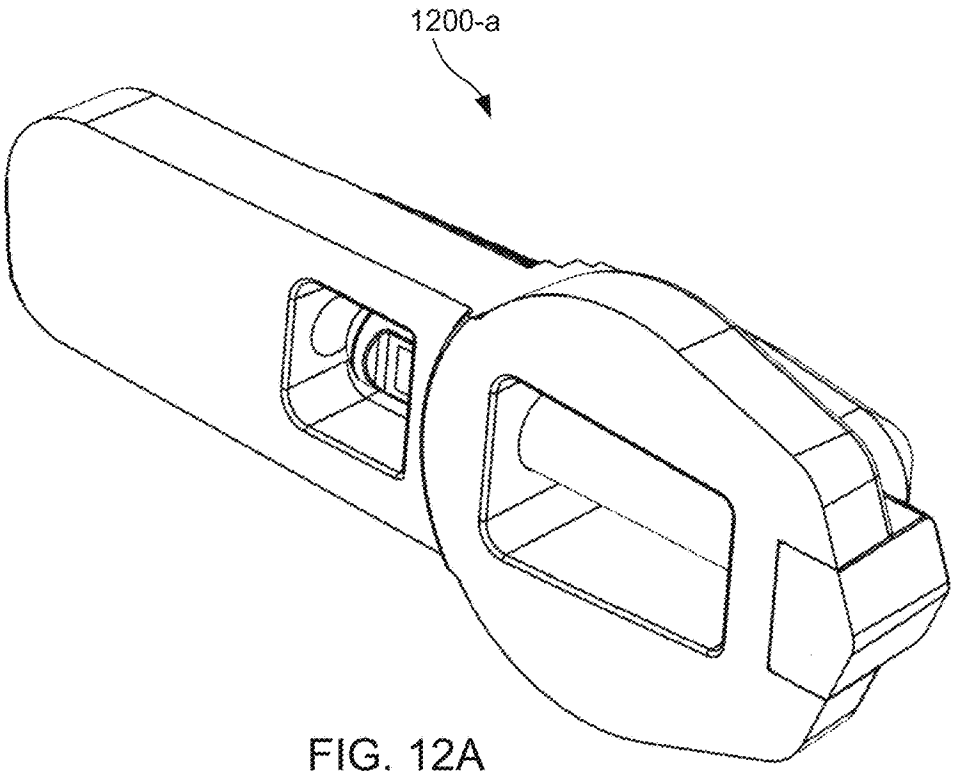

FIG. 12A illustrates a top perspective view of a hybrid selector lever 1200-*a* of a safety selector lever assembly, including its pin, according to an alternate embodiment of the disclosure. FIG. 12A depicts the internal face (i.e., side facing the firearm receiver) of the lever. FIG. 12B illustrates another top perspective view of a hybrid selector lever 1200-*b*, where the hybrid selector lever 1200-*b* is similar or substantially similar to the hybrid selector lever 1200-*a*. FIG. 12B depicts the external face of the lever, including an example of a second pattern of ridges 1236.

Figure 13B:
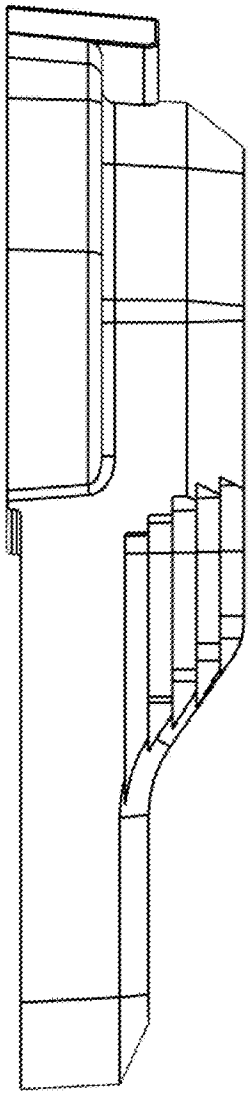
FIGS. 13A and 13B illustrate top views of levers of a safety selector lever assembly, according to an alternate embodiment of the disclosure.
Figure 13A:
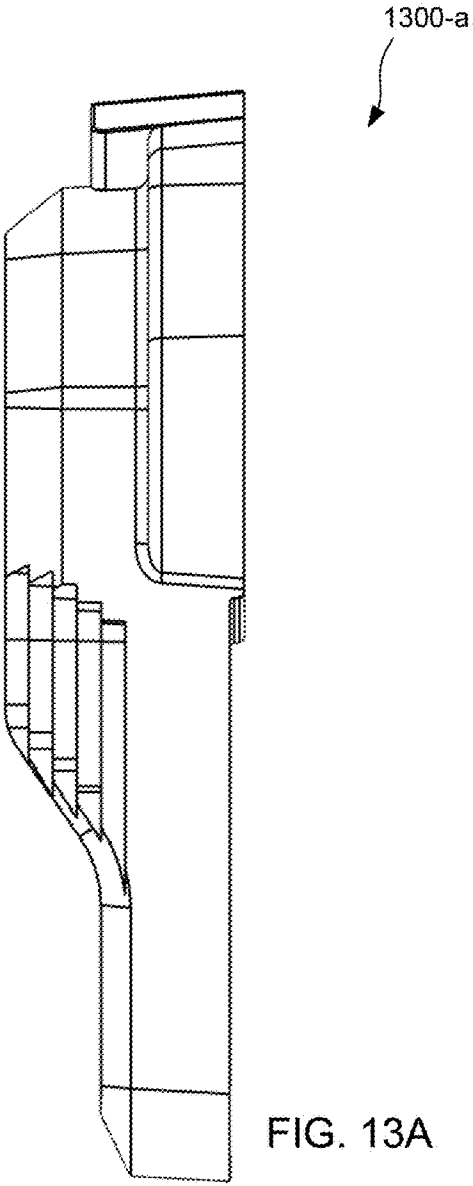
Figure 14A:
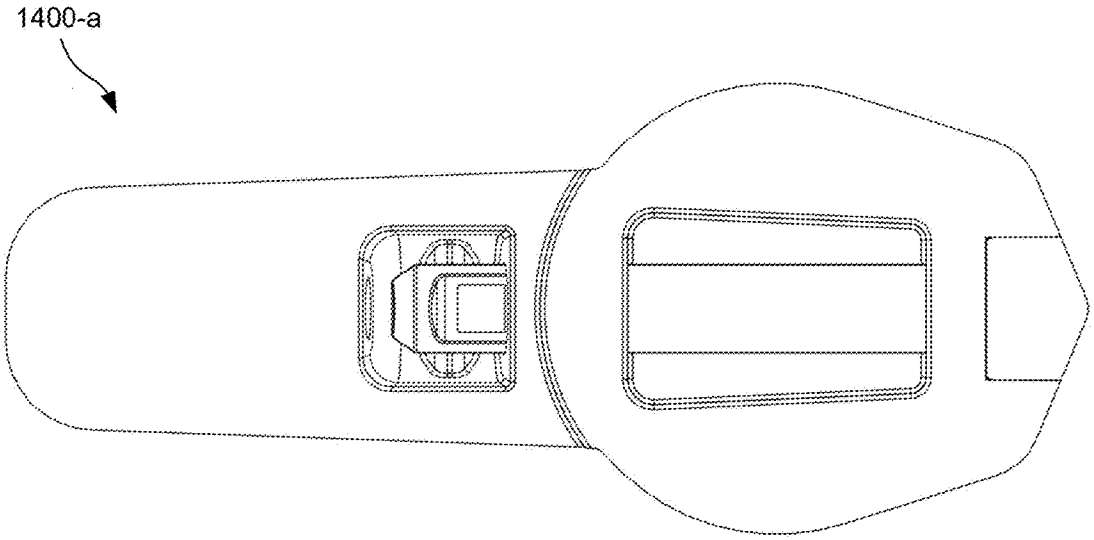
FIGS. 14A and 14B illustrate right and left-side views, respectively, of a lever of a safety selector lever assembly, according to an alternate embodiment of the disclosure.
Figure 14B:
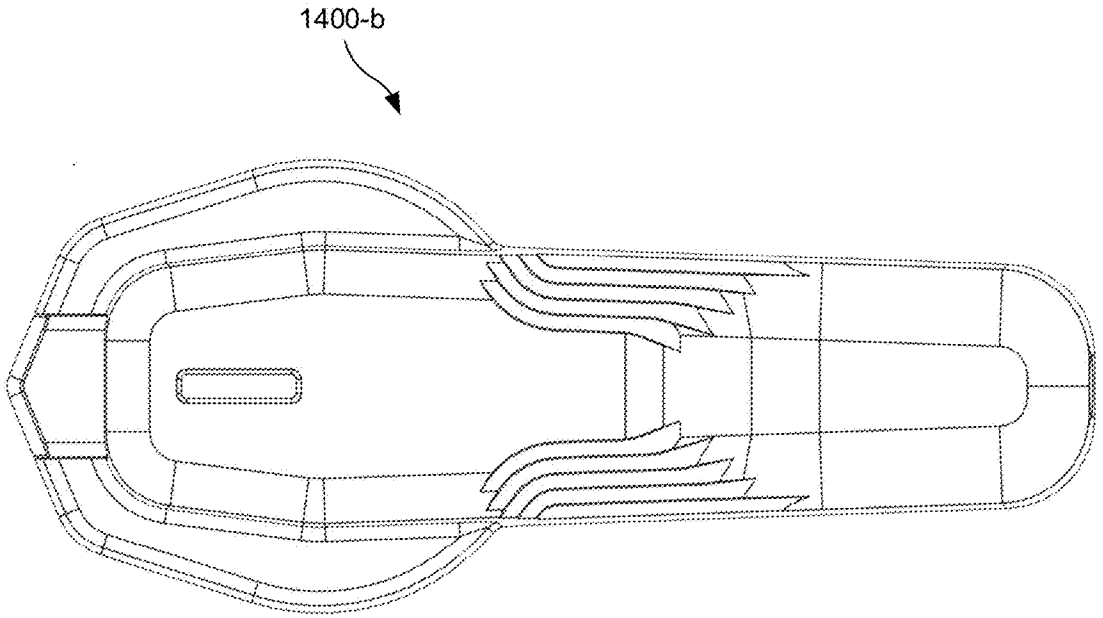
Figure 15B:
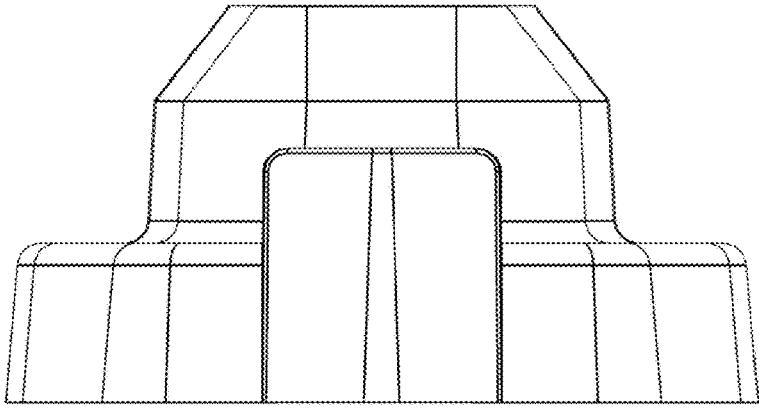
FIGS. 15A and 15B illustrate front and rear views, respectively, of a lever of a safety selector lever assembly, according to an alternate embodiment of the disclosure.
Figure 15A:
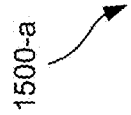
Figure 15A:
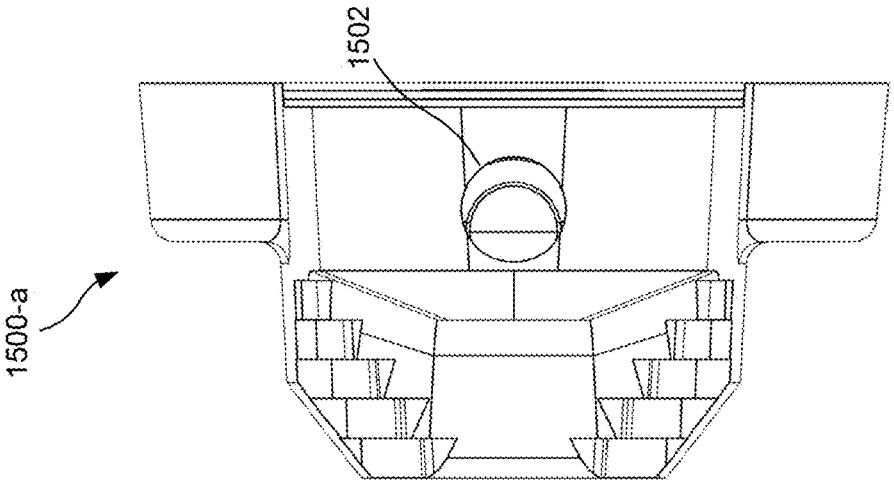

FIG. 13A illustrates a top view of a hybrid selector lever 1300-*a* of a safety selector lever assembly, including its pin, according to an alternate embodiment of the disclosure. FIG. 13B illustrates a bottom view of a hybrid selector lever 1300-*a* of a safety selector lever assembly, including its pin, according to an alternate embodiment of the disclosure. FIG. 14A illustrates a side view of a hybrid selector lever 1400-*a* of a safety selector lever assembly, including its pin, according to an alternate embodiment of the disclosure. FIG. 14B illustrates another side view of a hybrid selector lever 1400-*a* of a safety selector lever assembly, including its pin, according to an alternate embodiment of the disclosure. FIG. 15A illustrates a rear view of a hybrid selector lever 1500-*a* of a safety selector lever assembly, according to an embodiment of the disclosure. FIG. 15B illustrates a front view of a hybrid selector lever 1500-*b* of a safety selector lever assembly, including its pin, according to an embodiment of the disclosure. The hybrid selector lever 1500-*b* is similar or substantially similar to the hybrid selector lever 1500-*a* in FIG. 15A.

Figure 16:
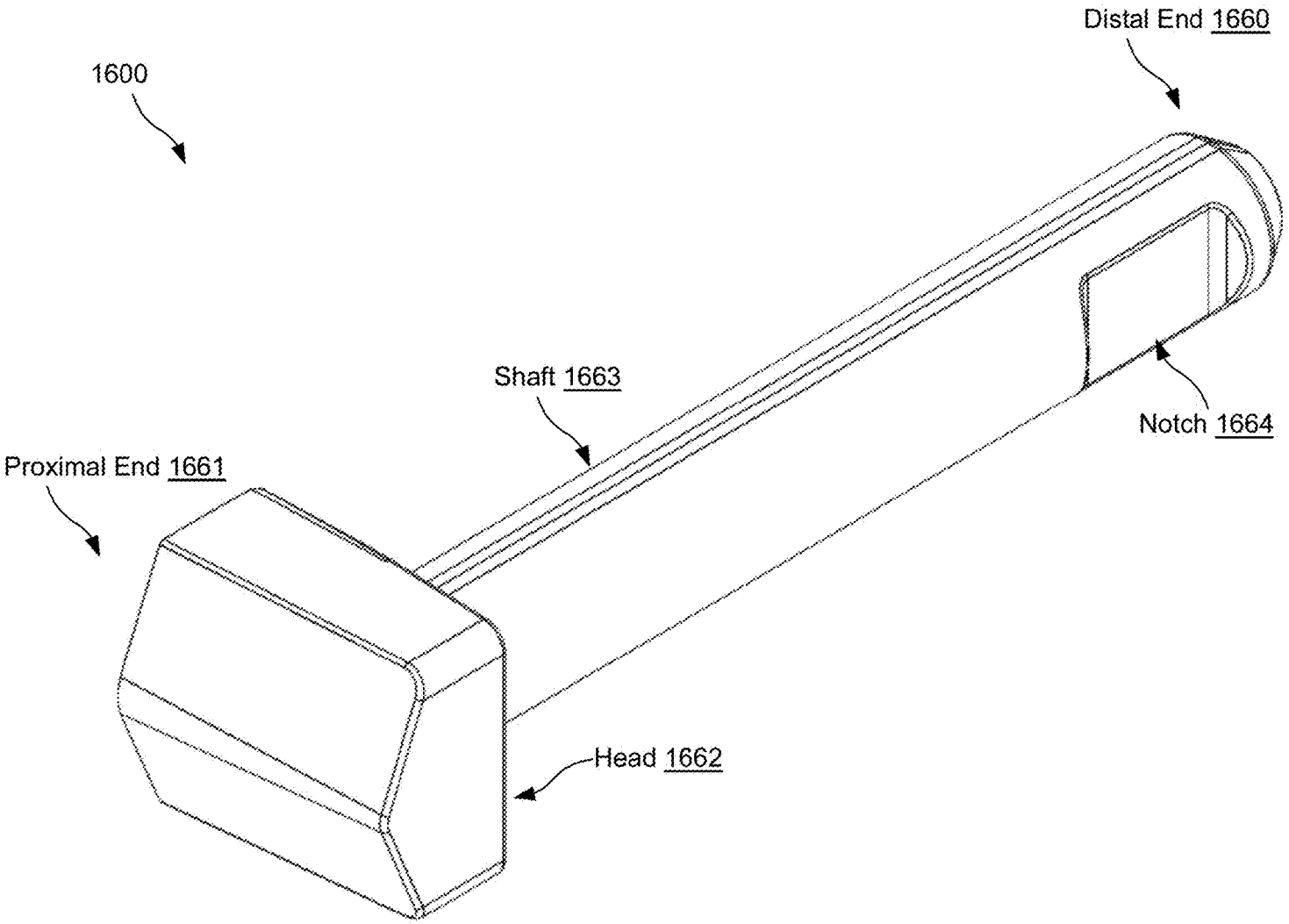
FIG. 16 illustrates a top perspective view of a pin or retainer of a safety selector lever assembly, according to various aspects of the disclosure.

FIG. 16 illustrates a top perspective view of a pin 1600 (or retainer 1600) of a safety selector lever assembly, according to various aspects of the disclosure. The pin 1600 comprises a proximal end 1661, a distal end 1660, a head 1662 at the proximal end, and at least one notch 1664 (e.g., outer notch 1664) at or near the distal end 1600. The pin 1600 also comprises a shaft 1663 extending from the head 1662 to the distal end 1660. In some cases, the pin 1600 helps removably couple the selector core (e.g., shown as selector core 106 in FIG. 2) to a lever of the selector lever assembly.

Figure 17:
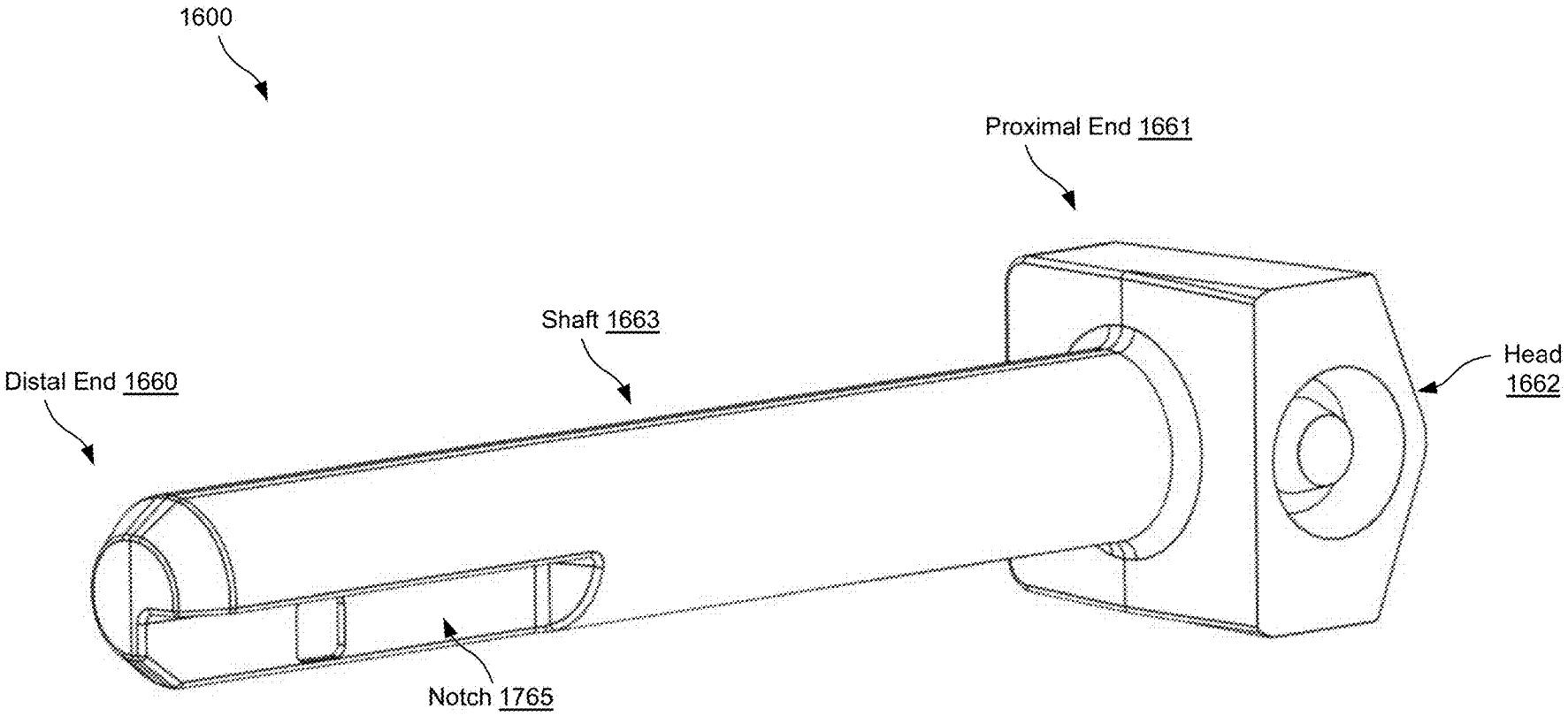
FIG. 17 illustrates another perspective view of the pin/retainer in FIG. 16, according to various aspects of the disclosure.

FIG. 17 illustrates another perspective view of the pin 1600 in FIG. 16, according to various aspects of the disclosure. In this view, an inner notch 1765 of the pin 1600 is visible. As compared to the notches shown and described in relation to FIG. 4, in some embodiments, one of the notches (e.g., inner notch) may terminate at the distal end of the pin. For example, in FIG. 4, both the inner and outer notches 119 and 118, respectively, are positioned along the length of the shaft 202 and terminate at a point that is proximal to the distal end of the pin/retainer. However, the pin/retainer 1600 comprises an outer notch (e.g., notch 1664 in FIG. 16) and an inner notch (e.g., notch 1765), where the inner notch extends to the distal end of the pin/retainer 1600, while the outer notch terminates at a point that is proximal to the distal end of the pin 1600. In some cases, the outer notch 1664 of the pin 1600 is shaped and sized to interface with (e.g., receive) a keyed detent in the lever, as previously described in relation to FIGS. 6A-B. For example, the distal end 1660 of the pin 1600 may be inserted through a first pin aperture at a proximal end of the lever. Next, the pin 1600 may be pushed (in a distal direction) until at least a portion of the shaft 1663 passes through the first pin aperture, an extension aperture of the selector core, and a second pin aperture of the lever. In some cases, the second pin aperture connects a first recess of the lever with a second recess of the lever, where the second recess comprises the keyed detent. In some cases, a user may push the head of the pin/retainer 1600 until the distal end 1660 of the pin is pushed past the keyed detent. Furthermore, the outer notch (e.g., notch 1664) may be shaped and sized to receive the keyed detent, which helps secure the lever to the selector core. As previously noted, the selector core may comprise at least one extension having an extension aperture, where the at least one extension is shaped and sized to be received in the first recess of a corresponding lever. In some cases, the first and second extension apertures of a lever may be aligned or substantially aligned with a corresponding extension aperture, e.g., when the corresponding extension is received in the first recess. This alignment allows each pin to extend through a corresponding extension of the selector core and help secure the selector core to the lever(s). In this way, aspects of the present disclosure allow tool-less assembly, installment, and/or disassembly of a safety selector lever assembly to a firearm receiver.

Figure 18:
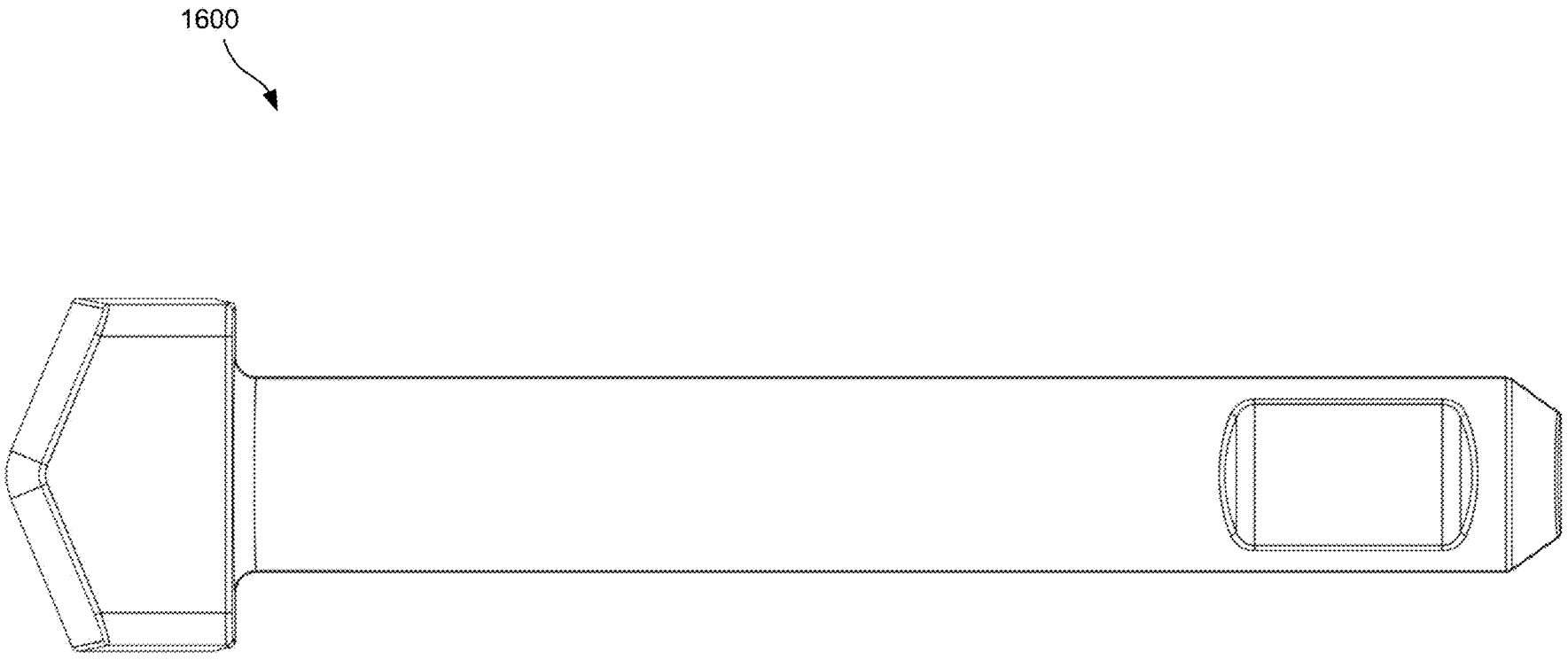
FIG. 18 illustrates a side view of the pin in FIG. 16, according to various aspects of the disclosure.
Figure 19:
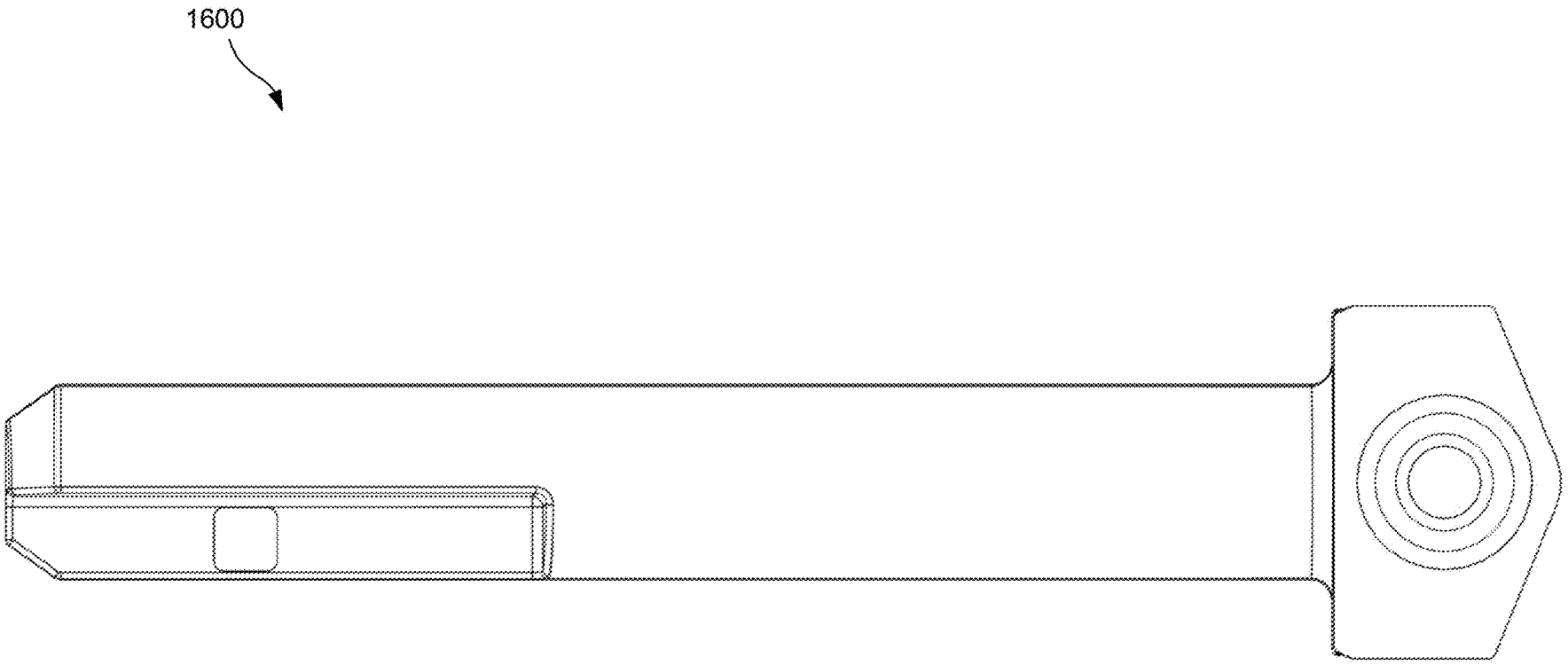
FIG. 19 illustrates another side view of the pin in FIG. 16, according to various aspects of the disclosure.
Figure 20:
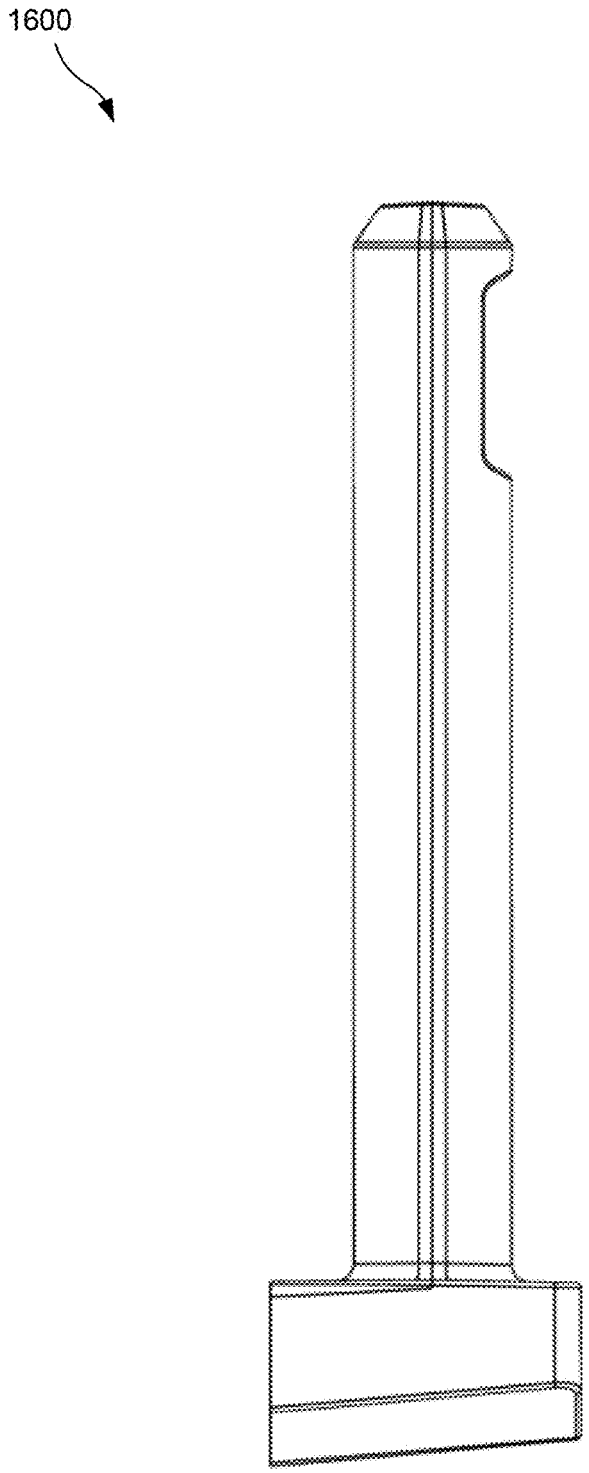
FIG. 20 illustrates a top view of the pin in FIG. 16, according to various aspects of the disclosure.
Figure 21:
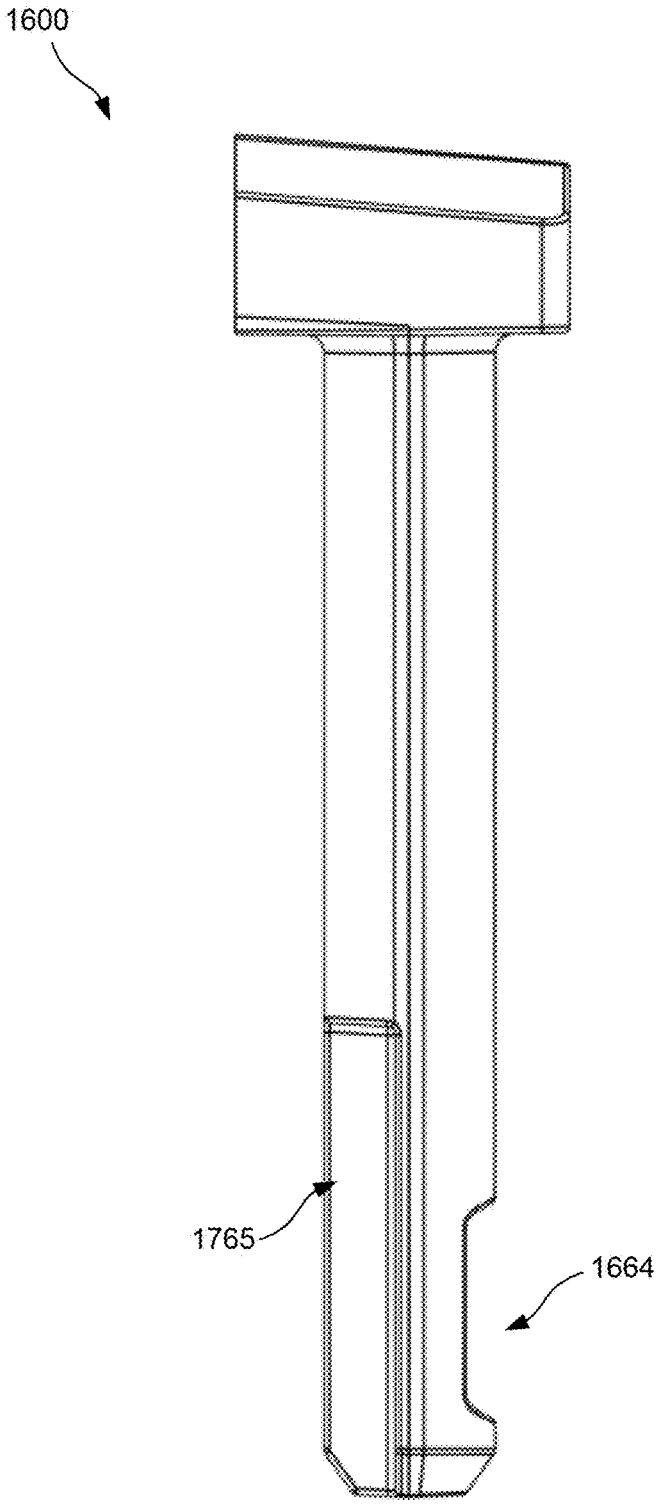
FIG. 21 illustrates a bottom view of the pin in FIG. 16, according to various aspects of the disclosure.
Figure 22:
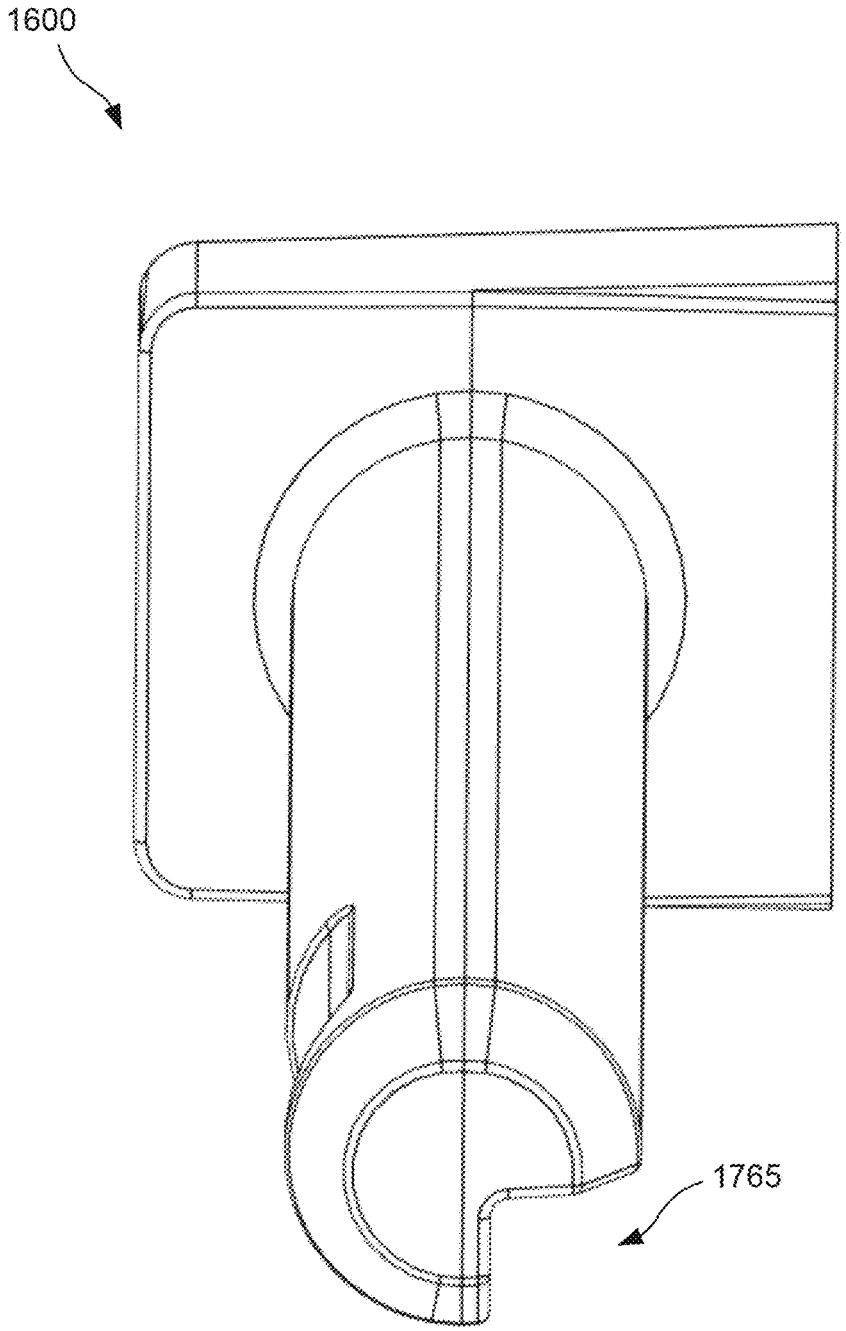
FIG. 22 illustrates a front perspective view of the pin in FIG. 16, according to various aspects of the disclosure.

FIG. 18 illustrates a side view of the pin/retainer 1600 in FIG. 16, according to various aspects of the disclosure. FIG. 19 illustrates another side view of the pin/retainer 1600 in FIG. 16, according to various aspects of the disclosure. FIG. 20 illustrates a top view of the pin/retainer 1600 in FIG. 16, according to various aspects of the disclosure. FIG. 21 illustrates a bottom view of the pin/retainer 1600 in FIG. 16, according to various aspects of the disclosure. FIG. 22 illustrates a rear perspective view of the pin/retainer 1600 in FIG. 16, including a detailed view of the inner notch 1765, according to various aspects of the disclosure.

Figure 23:
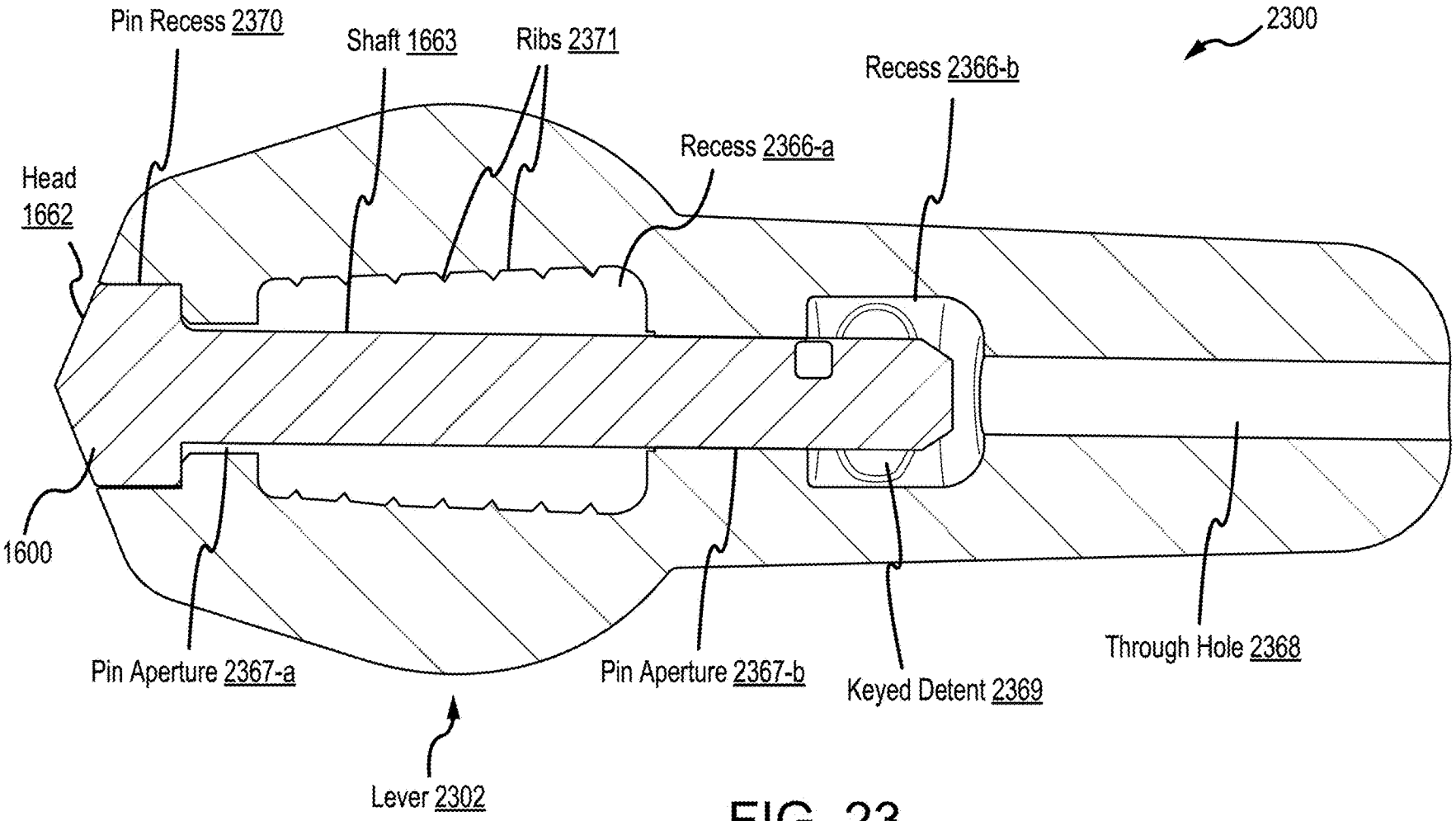
FIG. 23 illustrates a cross-sectional view of a pin installed in a lever of a safety selector lever assembly, according to various aspects of the disclosure.

FIG. 23 illustrates a cross-sectional view 2300 of a pin/retainer 1600 installed in a lever 2302 of a safety selector lever assembly, according to various aspects of the disclosure. As seen, the lever 2302 comprises a first pin aperture 2367-*a* positioned at or near the proximal end, a first recess 2366-*a*, a second pin aperture 2367-*a* positioned at the distal end of the first recess, a second recess 2366-*b*, a keyed detent 2369 in the second recess, and a through hole 2368 at the distal end of the lever 2302. The lever 2302 further comprises the pin 1600, where at least a portion of the pin 1600 is shaped and sized to be received in the first pin aperture 2367 and an extension aperture of the selector core (not shown). The lever 2302 further includes a pin recess 2370, where the pin recess surrounds at least a portion of the first pin aperture 2367-*a*. In some examples, one or more fit ribs 2371 may be provided around a perimeter of the first recess 2366-*a*, which helps provide a more snug fit of the extension of the selector core in the recess.

The pin 1600 is similar or substantially similar to the pins described herein, including at least in relation to FIGS. 16-22. The pin 1600 comprises a head 1662 at its proximal end and a shaft extending between the head 1662 and the distal end of the pin. As seen, the head 1662 of the pin 1600 is shaped and sized to be received within the pin recess 2370. As noted above, the pin 1600 helps removably couple the lever to a selector core, which allows for tool-less installment of the disclosed safety selector lever assembly in a firearm receiver (e.g., AR-15 receiver). In some cases, the removable coupling of the lever 2302 with the selector core is based at least in part on the shaft 1663 of the pin 1600 passing through the first pin aperture 2367, the extension aperture (of the selector core), and the second pin aperture 2367-*b*.

In this example, the second pin aperture 2367-*b* (i.e., positioned at the distal end of the first recess 2366-*a*) connects the first recess 2366-*a* and the second recess 2366-*b*. The second recess 2366-*b* comprises the keyed detent 2369, where the keyed detent 2369 is shaped and sized to be received within a notch (e.g., shown as outer notch 1664 in FIG. 16) of the pin 1600 when the distal end of the pin is pushed past the keyed detent. In some cases, the distal end of the lever 2302 comprises the through hole 2368 (optional), which allows for removal of the pin 1600 from the lever. For example, the distal end of the pin 1600 can be pushed in the proximal direction via the through hole 2368 and the head 1662 can be pulled to complete removal of the pin from the lever.

Figure 24:
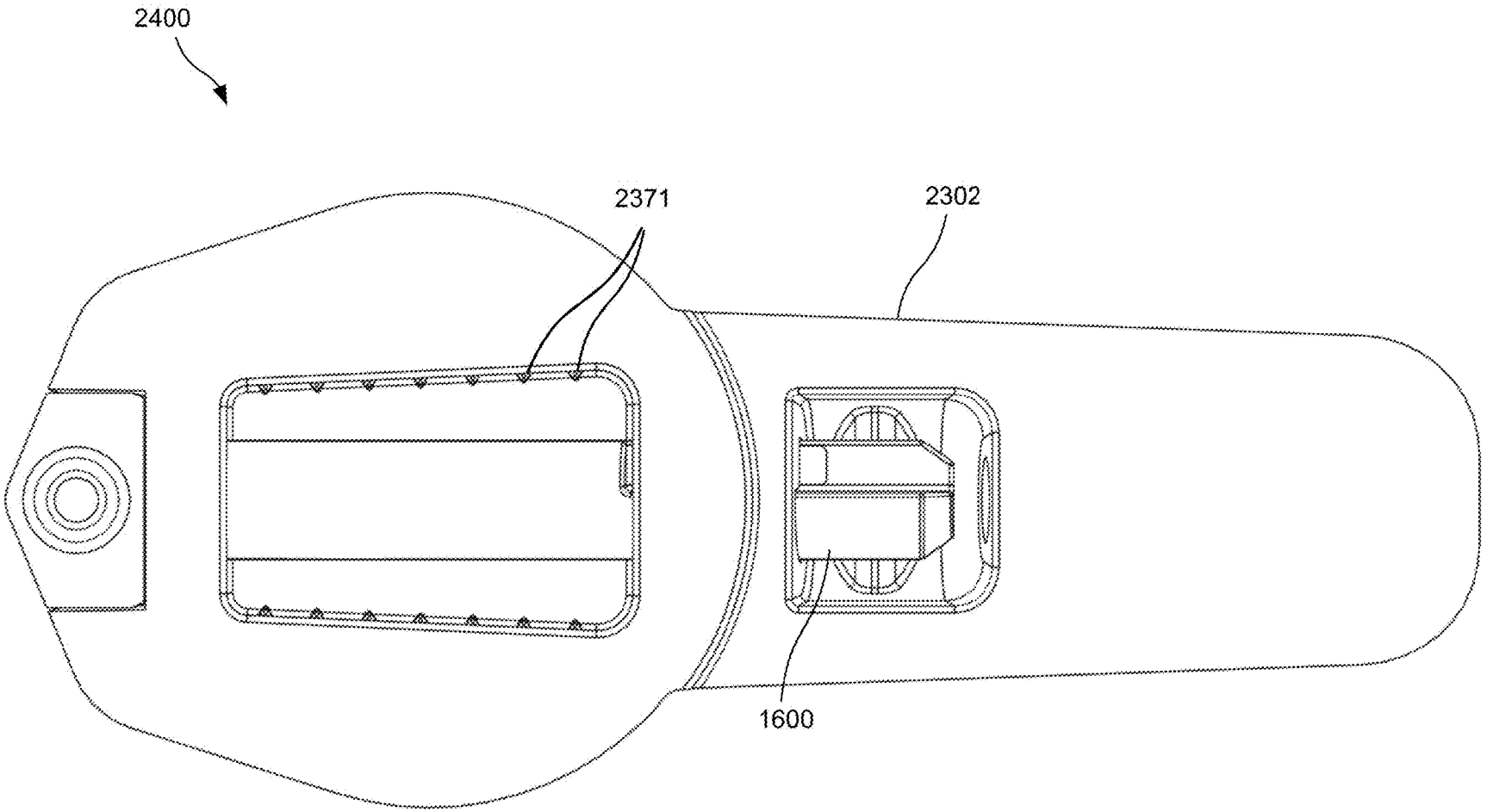
FIG. 24 illustrates a side view of a pin installed in a lever of a safety selector lever assembly, according to various aspects of the disclosure.
Figure 25:
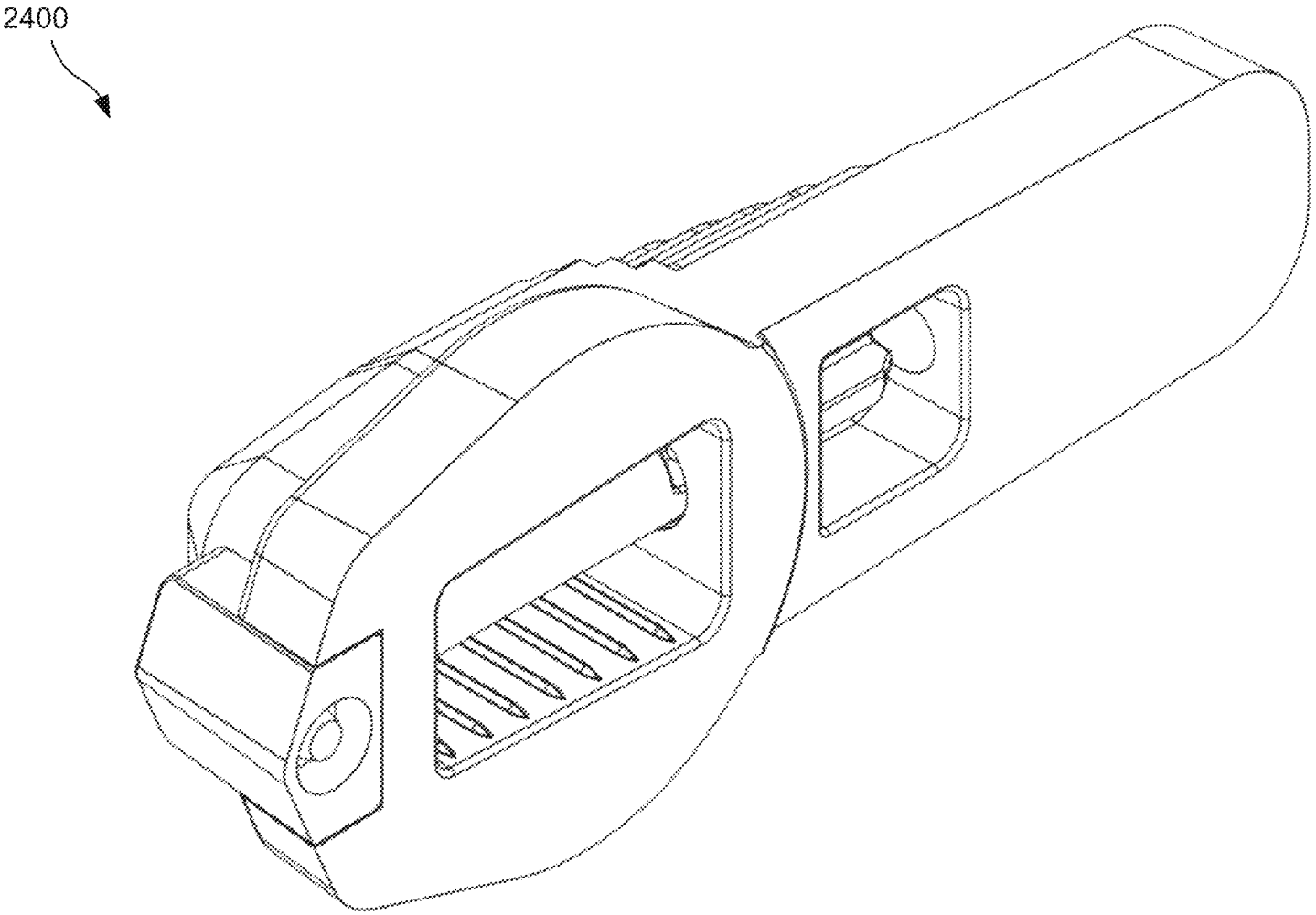
FIG. 25 illustrates a top perspective view of a pin installed in a lever of a safety selector lever assembly, according to various aspects of the disclosure.
Figure 26:
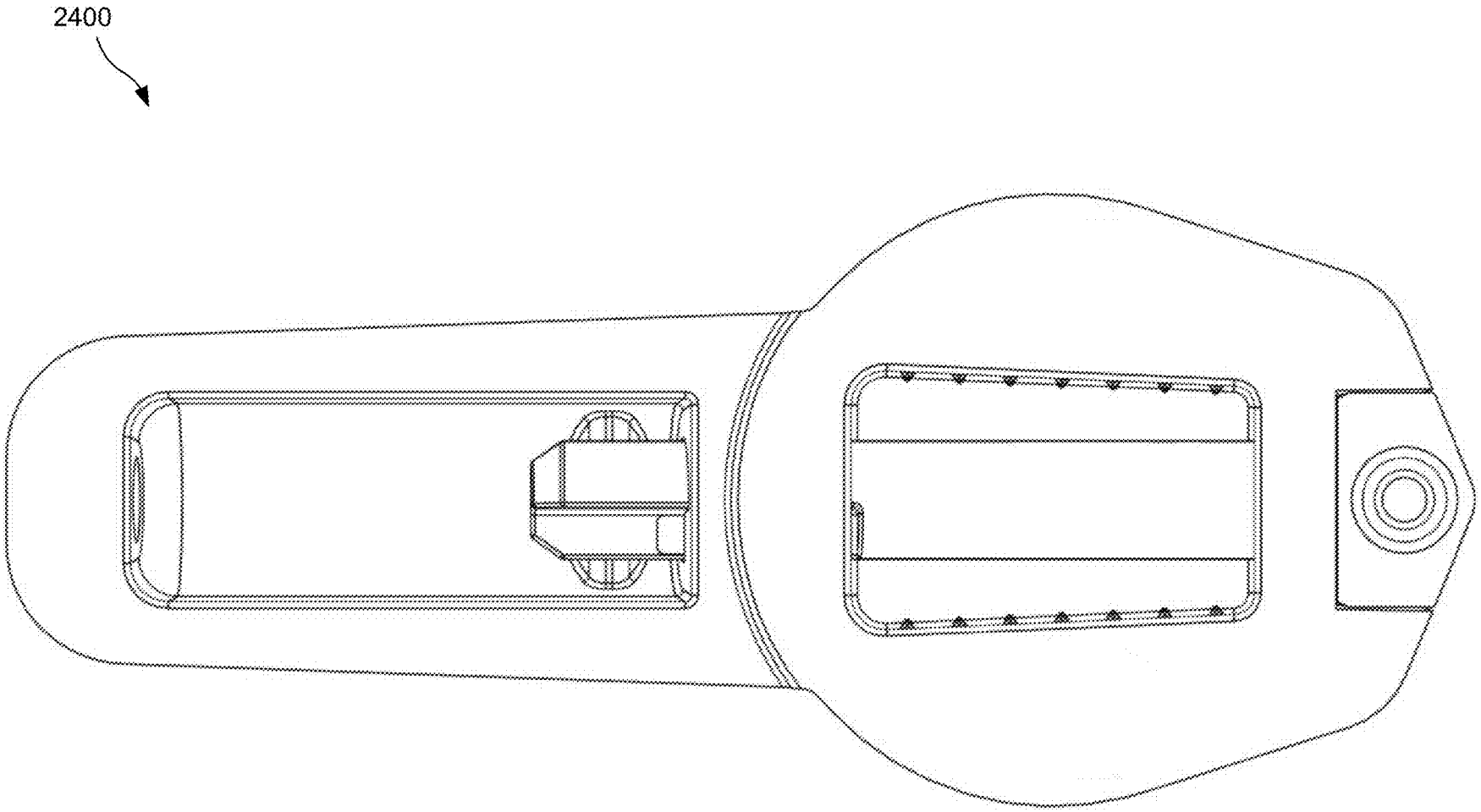
FIG. 26 illustrates another side view of a pin installed in a lever of a safety selector lever assembly, according to various aspects of the disclosure.
Figure 27:
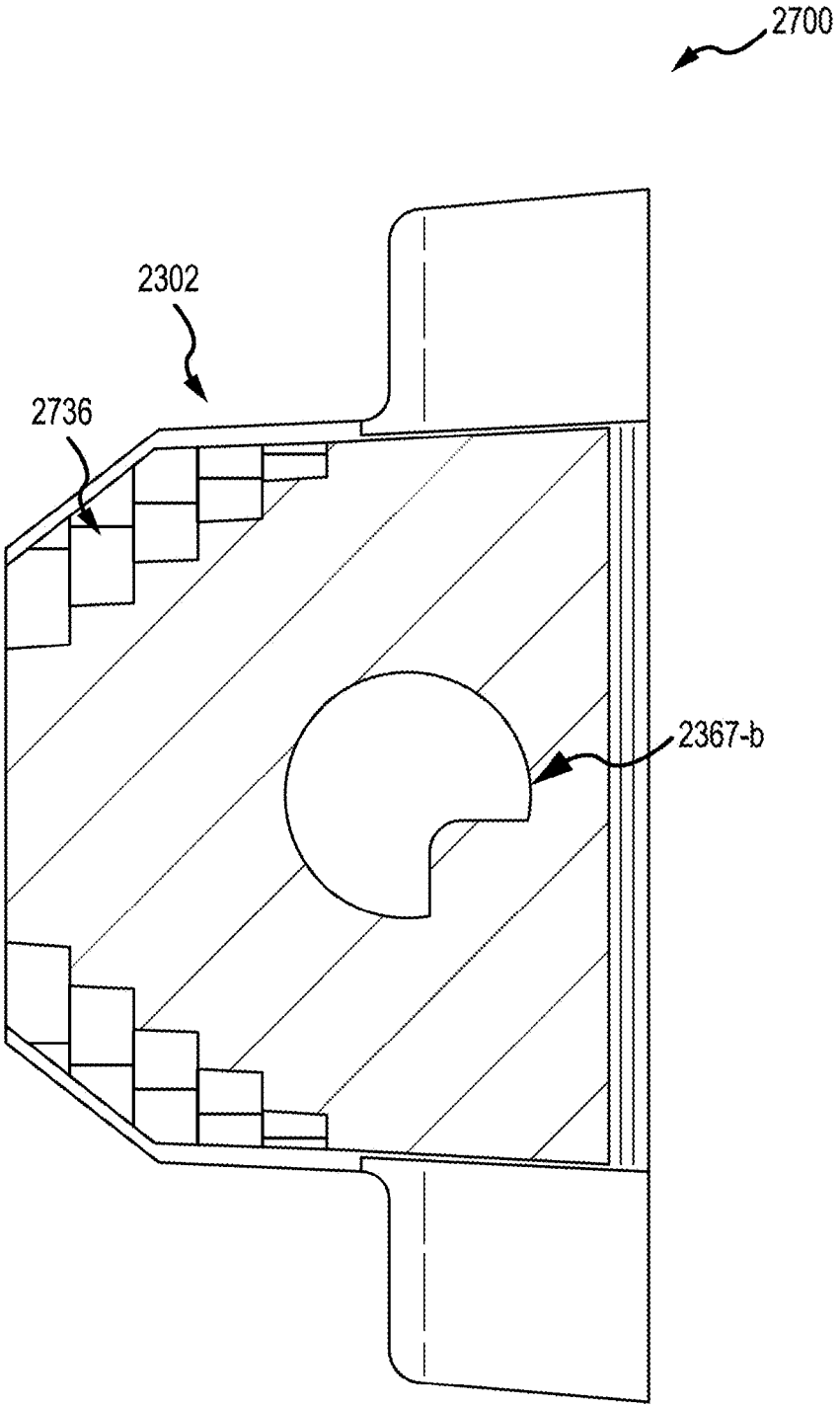
FIG. 27 illustrates a cross-sectional view of a lever of a safety selector lever assembly, according to various aspects of the disclosure.

FIG. 24 illustrates a side view of a of a safety selector lever assembly showing a pin/retainer 1600 installed in a lever 2302, according to various aspects of the disclosure. FIG. 25 illustrates a top perspective view of the safety selector lever assembly 2400 in FIG. 24, according to various aspects of the disclosure. FIG. 26 illustrates another side view of the safety selector lever assembly 2400 in FIG. 24, according to various aspects of the disclosure. FIG. 27 illustrates a cross-sectional view 2700 of a lever 2302 of a safety selector lever assembly as seen from the front (or distal end), according to various aspects of the disclosure. Specifically, FIG. 27 shows a detailed view of the second pin aperture 2367-*b* that connects the first recess (e.g., recess 2366-*a* in FIG. 23) with the second recess (e.g., recess 2366-*b*). In this example, the second pin aperture 2367-*b* has a similar or substantially similar shape (e.g., three quarter circle) as the inner notch (e.g., notch 1765) of the pin. This helps reduce play (i.e., prevents wobbling or lateral shifting of the pin) when the pin is inserted into the lever of the selector lever assembly.

Figure 28:
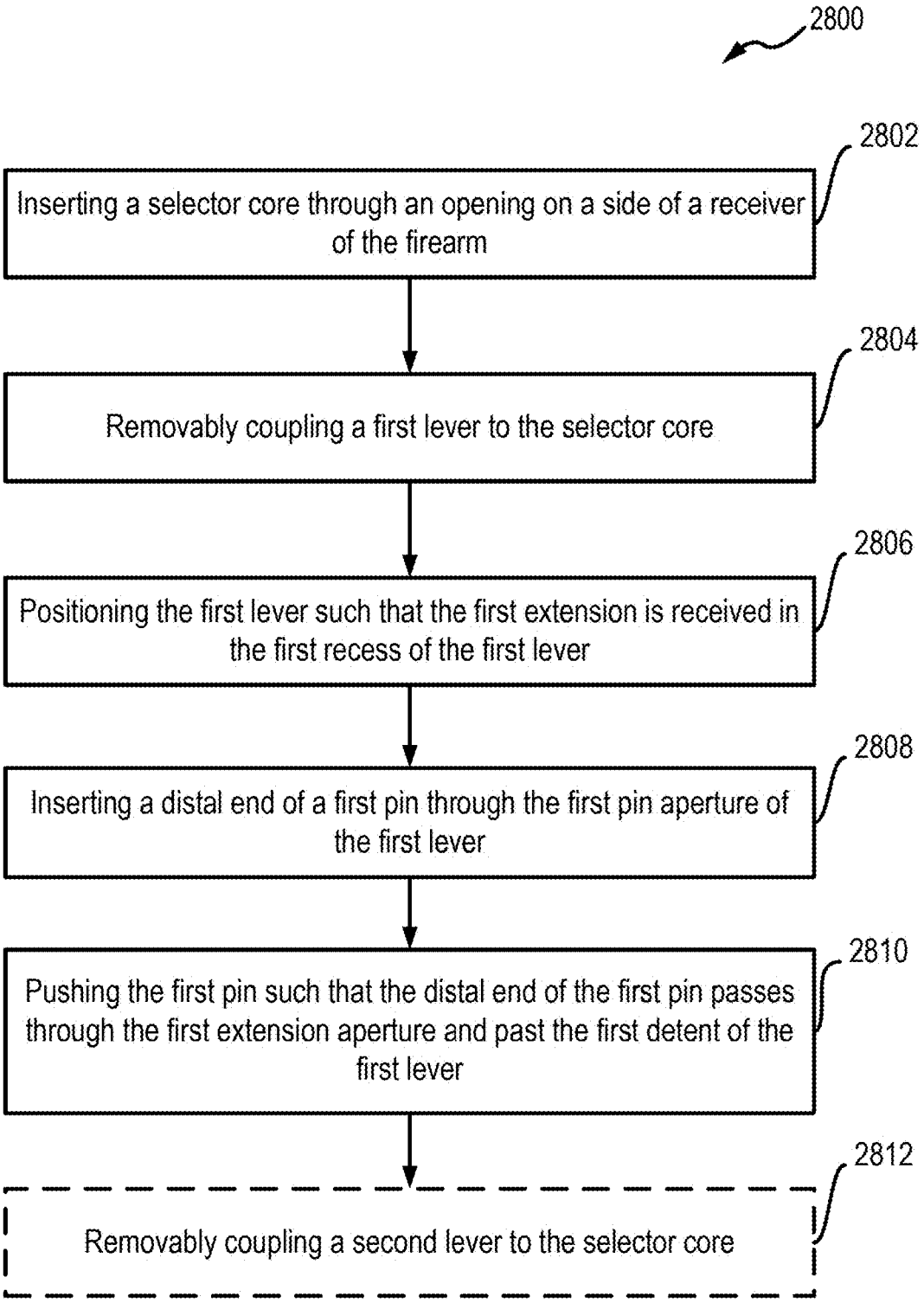
FIG. 28 illustrates an example of a method for using a safety selector lever assembly, according to various aspects of the disclosure.

FIG. 28 illustrates an example of a method 2800 for using a safety selector lever assembly, according to various aspects of the disclosure.

A first operation 2802 comprises inserting a selector core (e.g., selector core 106 in FIG. 1) through an opening on a side of a receiver of the firearm. In some cases, the selector core comprises at least a first elongated section having a curved face and at least one angled face, and a first extension positioned at a first end of the selector core. In some cases, the first extension is configured to protrude through the opening on the side (e.g., right side) of the receiver when the selector core is inserted into the opening. In some cases, the first extension further includes a first extension aperture.

A second operation 2804 comprises removably coupling a first lever to the selector core, where the first lever comprises a proximal end, a distal end, a first recess shaped and sized to receive the first extension of the selector core, a first pin aperture positioned at the proximal end, and a first detent (e.g., keyed detent). In some cases, removably coupling the first lever to the selector core further includes operations 2806-2810.

For example, at operation 2806, the method 2800 comprises positioning the first lever such that the first extension is received in the first recess of the first lever. At operation 2808, the method comprises inserting a distal end of a first pin through the first pin aperture of the first lever, where the first pin comprises at least one notch. Next, at operation 2810, the method comprises pushing the first pin such that the distal end of the first pin passes through the first extension aperture and past the first detent of the first lever. In some cases, at least a portion of the first pin passes through the first extension. In some cases, the first detent is received within one of the at least one notch of the first pin. In some examples, the method 2800 further comprises removably coupling a second lever to the selector core (operation 2812). In some cases, operation 2812 is optional (shown as optional by the dashed lines). In some cases, the selector core may further comprise a second extension, where the second extension is positioned at a second end of the selector core, the second end opposing the first end. The second extension is configured to protrude through another opening on an opposing side (e.g., left side) of the receiver. Similar to the first extension, the second extension may also include a second extension aperture. The second lever may also comprise a proximal end, a distal end, a first recess shaped and sized to receive the second extension of the selector core, a first pin aperture positioned at the proximal end, and a second detent (e.g., keyed detent). In some embodiments, removably coupling the second lever to the selector core comprises (1) positioning the second lever such that the second extension is received in the first recess of the second lever, (2) inserting a distal end of a second pin through the first pin aperture of the second lever, wherein the second pin comprises at least one notch, and (3) pushing the second pin such that the distal end of the second pin passes through the second extension aperture and past the second detent of the second lever. In some cases, at least a portion of the second pin passes through the second extension, which allows the second detent to be received within one of the at least one notch of the second pin.

While the present disclosure generally describes an ambidextrous safety selector lever assembly comprising two levers positioned on opposing sides of a firearm receiver, in some embodiments, the safety selector lever assembly may be non-ambidextrous. In such cases, the safety selector lever assembly may comprise a single lever positioned on one side of the receiver and removably coupled to a first end of the selector core. Additionally, the second, opposing end of the selector core may be flat. For example, and with reference to FIG. 2, a non-ambidextrous variant of the safety selector lever assembly may comprise the selector core 106, lever 102-*a*, and pin 104-*a*, where the selector core 106 comprises the first extension 222-*a*, the first cylindrical section 108-*a*, the elongated section 110 and angled faces 120, and the second cylindrical section 108-*b*. That is, the second extension 222-*b*, pin 104-*b*, and lever 102-*b* may not be present in the non-ambidextrous selector lever. In such cases, the flat face of the second cylindrical section 108-*b* may be flush, or substantially flush, against the second side of the receiver.

Additionally, while the present disclosure generally describes two positions for the levers and/or selector core (e.g., FIRE, SAFE), it is contemplated that three or more positions can be utilized in different embodiments. For instance, the levers and/or selector core can be rotatable between a first position (e.g., Safe), a second position (e.g., Semi Auto), a third position (e.g., Burst Fire), and a fourth position (e.g., Full Auto).

It should also be noted that other safety mechanisms (i.e., besides levers) using the same or similar attachment mechanism (i.e., the pins/retainers) to the selector core can be utilized in different embodiments without departing from the scope or spirit of this disclosure. In one non-limiting example, a non-rotating safety (e.g., button head, slide safety) may be mounted to a linear cross-bolt safety which translates left-right (as opposed to rotating). For example, the rotating levers 102-*a*, 102-*b* can be replaced by a slide safety that is movable in the front-back direction, where the slide safety is positioned flush or substantially flush against a side of the firearm receiver. In such cases, the front-back movement of the slide safety translates to a corresponding rotation of the selector core 106, for instance, via a gear mechanism, a screw-and-nut system, a piston, or any other applicable linear to rotary motion converter. In some other cases, the safety selector lever assembly, for instance, using a fore-aft slide safety can be configured to be installed on a top side of the firearm receiver.

In some embodiments, the safety selector lever assembly comprising the non-rotatable safety (e.g., slide safety, button head, tang safety) can be ambidextrous or non-ambidextrous. That is, the slide safety or other non-rotatable safety selector lever assembly (e.g., tang safety) can be positioned on both sides of the firearm receiver. In other cases, the safety selector lever assembly comprising the non-rotatable safety can be ambidextrous but may include a single slide safety, for instance, on the top side of the firearm receiver. The slide safety may be movable (e.g., left-right, front-back, top-bottom, to name a few) within a channel. Additionally, the pin/retainer may be installed through a pin aperture on an outside face of the slide safety, where the pin aperture passes through the entire height/depth of the slide safety, and the bottom/distal end of the pin passes through the extension aperture in the selector core. In some cases, the extension aperture of the selector core may be shaped (e.g., tapered such that it is wider at the top and narrower at the bottom, or maybe chamfered) such that the distal end of the pin can pass relatively easily into the extension aperture, but is prevented from accidental removal. Additionally, the non-rotatable safety (e.g., slide or tang safety) may be movable between two or more positions (e.g., first position=SAFE, second position=SEMI AUTO FIRE, third position=BURST FIRE, fourth position=FULL AUTO FIRE). In some examples, moving the non-rotatable safety may cause a corresponding movement (e.g., rotation) of the selector core with respect to the firing assembly. For example, when in the first position, the selector core may be oriented such that a trigger or sear of the firearm is pivotable to release a hammer of the firearm, or the trigger is movable in a linear direction, and wherein, when in the second position, the selector core is oriented such that a trigger or sear of the firearm is prevented from rotating, or the trigger is prevented from moving in a linear direction. Additionally, if the firearm is configured for burst and/or full automatic fire rates, the selector core can be oriented to a third position and/or a fourth position, respectively.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A safety selector lever assembly for a firearm, comprising:

a selector core, wherein the selector core comprises:

a first elongated section;

a first extension and a second extension, wherein the first extension and the second extension are positioned on opposing ends of the selector core;

wherein each of the first extension and the second extension comprise an extension aperture, and wherein the first elongated section is positioned between the first and the second extensions;

a plurality of levers, wherein each of the plurality of levers comprises:

a proximal end and a distal end;

a first recess that is shaped and sized to receive one of the first extension and the second extension of the selector core, wherein the first recess is positioned at or near a proximal end of a corresponding lever;

a first pin aperture positioned at the proximal end of a corresponding lever;

a pin comprising:

a distal end having an inner notch and an outer notch;

a proximal end having a head; and a shaft positioned between the head and the distal end, and wherein at least a portion of the pin is shaped and sized to be received in the first pin aperture and the corresponding extension aperture;

wherein each of the plurality of levers is removably coupled to the selector core, and wherein rotation of at least one of the plurality of levers to a first position enables firing of the firearm while rotation of at least one of the plurality of levers to a second position precludes firing of the firearm.

2. The safety selector lever assembly of claim 1, wherein each of the plurality of levers further comprises:

a second pin aperture positioned at a distal end of a corresponding first recess; and a pin recess, wherein the pin recess surrounds at least a portion of the first pin aperture;

and wherein:

the head of each pin is shaped and sized to be received within a corresponding pin recess; and removable coupling of each of the plurality of levers with the selector core is based at least in part on the shaft of a corresponding pin passing through the first pin aperture, the extension aperture, and the second pin aperture.

3. The safety selector lever assembly of claim 1, wherein:

the inner notch and the outer notch comprise a different length, a different shape, a different depth, or a combination thereof.

4. The safety selector lever assembly of claim 1, wherein the head of each pin is shaped to fit flush or substantially flush against one or more of:

a receiver of the firearm; and the proximal end of a corresponding lever.

5. The safety selector lever assembly of claim 1, wherein:

removable coupling of each of the plurality of levers with the selector core is based at least in part on the at least the portion of each pin passing through a respective one of the first extension and the second extension.

6. The safety selector lever assembly of claim 1, wherein each of the plurality of levers further comprises:

a second pin aperture positioned at a proximal end of a corresponding first recess;

a second recess, wherein the second recess is positioned between the first recess and the distal end of the corresponding lever;

and wherein the second pin aperture connects the first recess and the second recess of the corresponding lever.

7. The safety selector lever assembly of claim 6, wherein the second recess of at least one of the plurality of levers comprises:

a keyed detent, wherein the keyed detent is shaped and sized to be received within a notch of a corresponding pin when a distal end of the pin is pushed past the keyed detent.

8. The safety selector lever assembly of claim 1, wherein the selector core further comprises:

a detent channel with a plurality of detent recesses positioned between the first elongated section and one of the first or second extensions, wherein the plurality of detent recesses are shaped and sized to receive an end of a detent pin to secure rotation of the selector core.

9. The safety selector lever assembly of claim 8, wherein the detent pin comprises a spring-loaded detent pin, and wherein:

when the plurality of levers are in the first position, the end of the spring-loaded detent pin is biased into a first one of the detent recesses; and when the plurality of levers are in the second position, the end of the spring-loaded detent pin is biased into a second one of the detent recesses.

10. The safety selector lever assembly of claim 1, wherein at least one of the plurality of levers and the plurality of pins comprises a visual indicator to indicate a current state of the firearm, wherein the current state comprises one of a FIRE state and a SAFE state.

11. The safety selector lever assembly of claim 1, wherein, the plurality of levers comprise a first lever and a second lever, the first lever and the second lever positioned on opposing sides of a receiver of the firearm; and the selector core passes through the receiver.

12. The safety selector lever assembly of claim 11, wherein the first lever and the second lever comprise one or more of:

a different length;

a different maximum depth or maximum height; and a different shape.

13. The safety selector lever assembly of claim 1, wherein when in the first position, the first elongated section is oriented such that a trigger or sear of the firearm is pivotable to release a hammer of the firearm, or the trigger is movable in a linear direction, and wherein when in the second position, the first elongated section is oriented such that a trigger or sear of the firearm is prevented from rotating, or the trigger is prevented from moving in a linear direction.

14. A method of using a safety selector lever assembly for a firearm, comprising:

inserting a selector core through an opening on a side of a receiver of the firearm, wherein the selector core comprises:

a first elongated section;

a first extension, wherein the first extension is positioned at a first end of the selector core and protrudes through the opening on the side of the receiver;

wherein the first extension comprises a first extension aperture;

removably coupling a first lever to the selector core, wherein the first lever comprises a proximal end, a distal end, a first recess shaped and sized to receive the first extension of the selector core, a first pin aperture positioned at the proximal end, and a first detent, and wherein removably coupling the first lever to the selector core comprises:

positioning the first lever such that the first extension is received in the first recess of the first lever;

inserting a distal end of a first pin through the first pin aperture of the first lever, wherein the first pin comprises:

a distal end having an inner notch and an outer notch;

a proximal end having a head; and a shaft positioned between the head and the distal end; and pushing the first pin such that the distal end of the first pin passes through the first extension aperture and past the first detent of the first lever, wherein at least a portion of the first pin passes through the first extension, and wherein the first detent is received within one of the inner notch and the outer notch of the first pin.

15. The method of claim 14, wherein the selector core further comprises:

a second extension, wherein the second extension is positioned at a second end of the selector core, the second end opposing the first end, and wherein the second extension protrudes through another opening on an opposing side of the receiver;

and wherein the second extension comprises a second extension aperture.

16. The method of claim 15, further comprising:

removably coupling a second lever to the selector core, wherein the second lever comprises a proximal end, a distal end, a first recess shaped and sized to receive the second extension of the selector core, a first pin aperture positioned at the proximal end, and a second detent, and wherein removably coupling the second lever to the selector core comprises:

positioning the second lever such that the second extension is received in the first recess of the second lever;

inserting a distal end of a second pin through the first pin aperture of the second lever, wherein the second pin comprises at least one notch; and pushing the second pin such that the distal end of the second pin passes through the second extension aperture and past the second detent of the second lever, wherein at least a portion of the second pin passes through the second extension, and wherein the second detent is received within one of the at least one notch of the second pin.

17. The method of claim 16, further comprising:

rotating at least one of the first lever and the second lever, and wherein rotation of at least one of the first lever and the second lever results in a corresponding rotation of the selector core, and wherein each of the first lever and the second lever is rotatable between a first position and a second position;

wherein, when in the first position, the first elongated section is oriented to allow firing of the firearm; and wherein, when in the second position, the first elongated section is oriented to preclude firing of the firearm.

18. A firearm configured for a selectable fire rate, the firearm comprising:

a receiver having at least one opening and a firing assembly;

a safety selector lever assembly, the safety selector lever assembly comprising:

a selector core having a first elongated section, and a first extension positioned at a first end of the selector core, wherein the first extension comprises a first extension aperture and is shaped and sized to protrude through the opening; and a lever removably coupled to the selector core, where the lever comprises:

a first recess that is shaped and sized to receive the first extension;

a first pin aperture and a second pin aperture positioned on opposing ends of the first recess;

a second recess comprising a keyed detent; and a pin comprising a notch;

wherein the lever is removably coupled to the selector core via insertion of one end of the pin through the first pin aperture, the extension aperture, and the second pin aperture, wherein at least a portion of the pin extends past the keyed detent and the keyed detent is received within the notch of the pin; wherein the pin can be removed in a tool-less manner to disassemble the lever and the selector core;

and wherein rotation of the lever results in a corresponding rotation of the selector core, and wherein the lever is rotatable between a plurality of positions, each position resulting in a different orientation of the first elongated section with respect to the firing assembly.

19. The firearm of claim 18, wherein the lever comprises a through hole extending from the second recess to an outside of the lever for removal of the pin from the lever.

* * * * *